US006592056B2

(12) United States Patent
Yamakawa et al.

(10) Patent No.: US 6,592,056 B2
(45) Date of Patent: Jul. 15, 2003

(54) GLUING DEVICE, BOOKBINDING APPARATUS WITH THE GLUING DEVICE AND IMAGE FORMING APPARATUS WITH BOOKBINDING APPARATUS

(75) Inventors: Mikihiro Yamakawa, Saitama (JP); Tsuyoshi Tsuchiya, Tokyo (JP); Katsunori Takahashi, Tokyo (JP); Toshio Shida, Tokyo (JP); Makoto Tamura, Saitama (JP); Toshitaka Matsumoto, Tokyo (JP); Hitoshi Tamura, Tokyo (JP)

(73) Assignee: Konica Corporation, Tokyo (JP)

( * ) Notice: Subject to any disclaimer, the term of this patent is extended or adjusted under 35 U.S.C. 154(b) by 35 days.

(21) Appl. No.: 09/894,393

(22) Filed: Jun. 28, 2001

(65) Prior Publication Data

US 2002/0002943 A1 Jan. 10, 2002

(30) Foreign Application Priority Data

Jul. 4, 2000 (JP) ..... 2000-202042
Aug. 7, 2000 (JP) ..... 2000-238355

(51) Int. Cl.[7] ..... B05B 1/30
(52) U.S. Cl. ..... 239/569; 412/37; 412/8
(58) Field of Search ..... 412/1, 8, 37, 36, 412/900, 901, 902; 239/63, 75, 569, 583, 586, 584

(56) References Cited

U.S. PATENT DOCUMENTS 4,473,425 A 9/1984 Baughman et al.
5,152,455 A * 10/1992 Palmers ..... 239/73
5,782,410 A * 7/1998 Weston ..... 239/63
6,164,568 A * 12/2000 Muller et al. ..... 239/586

FOREIGN PATENT DOCUMENTS

JP 59-500907 5/1984
JP 07-080377 3/1995

* cited by examiner

*Primary Examiner*—Willmon Fridie, Jr.
(74) *Attorney, Agent, or Firm*—Frishauf, Holtz, Goodman & Chick, P.C.

(57) ABSTRACT

A gluing device having therein a pressuring means which presses a glue container containing a liquid glue to eject contained glue from an ejection opening, a supply tube through which the ejected glue is transported from the glue container, a connecting means on the glue container side which connects the supply tube to the glue container, a connecting means on the supply tube side which detachably connects the connecting means on the glue container side to the supply tube, and a glue discharging means which receives the glue transported through the supply tube and delivers them from a nozzle opening, wherein there is provided a valve member provided inside the connecting means on the glue container side that makes the ejection opening to be opened and closed, and a protrusion is provided inside the connecting means on the supply tube side so that the protrusion presses the valve member to open the ejection opening when the connecting means on the supply tube side is connected to the connecting means on the supply tube side.

13 Claims, 28 Drawing Sheets

FIG. 8 ( a )
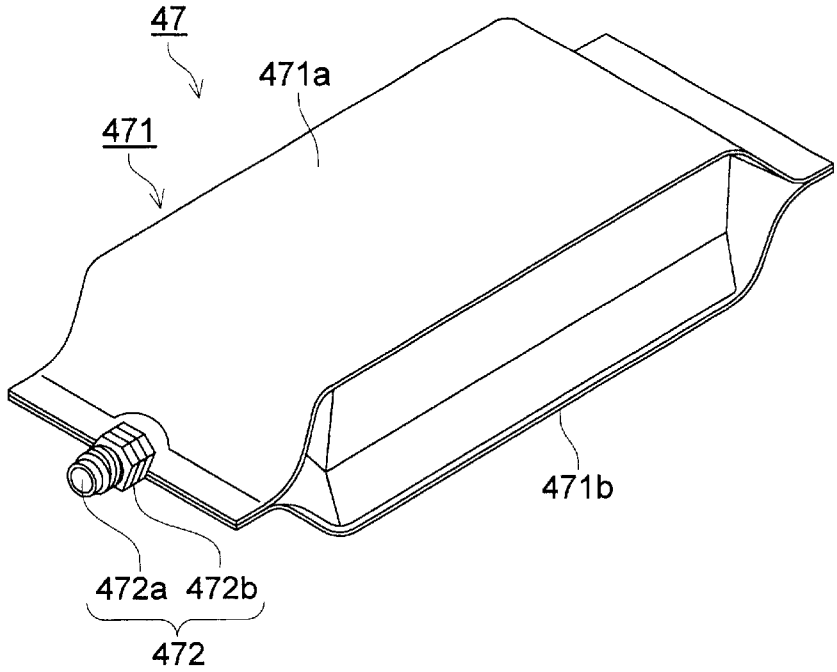
FIG. 8 ( b )
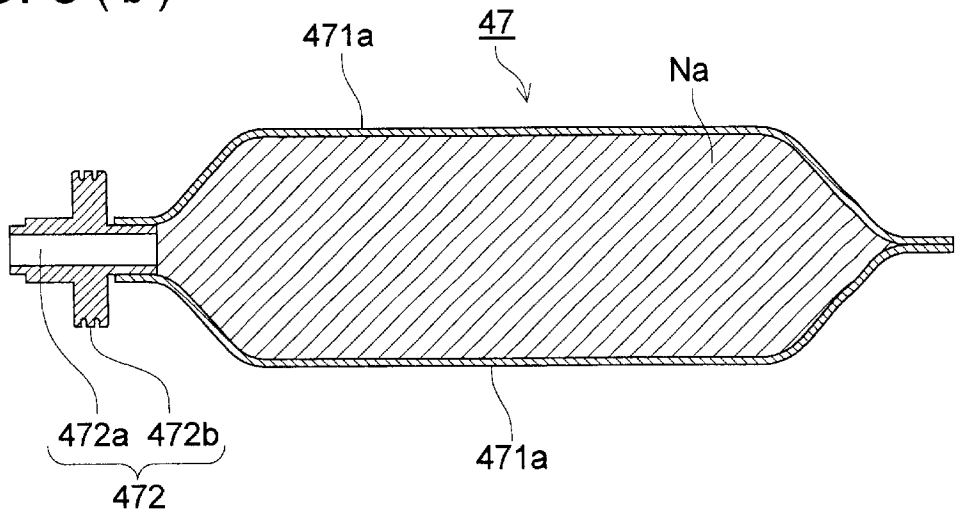

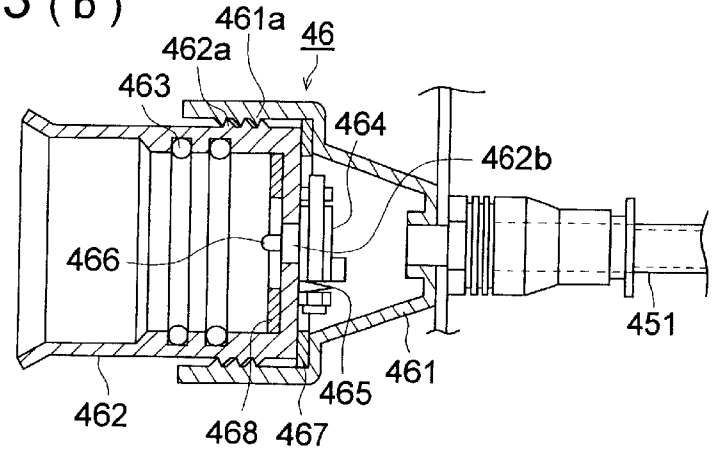
FIG. 13 ( b )
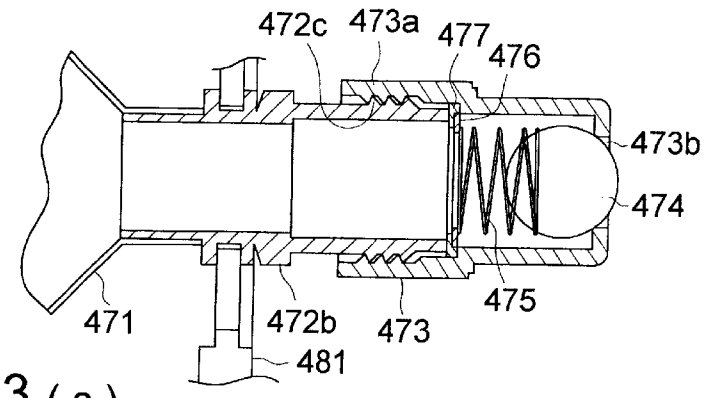
FIG. 13 ( a )
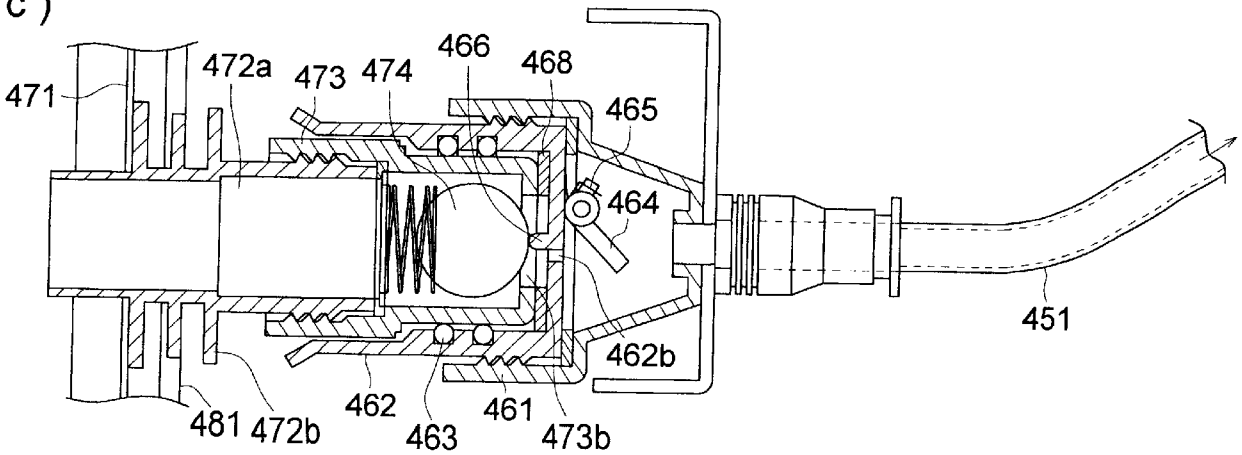
FIG. 13 ( c )

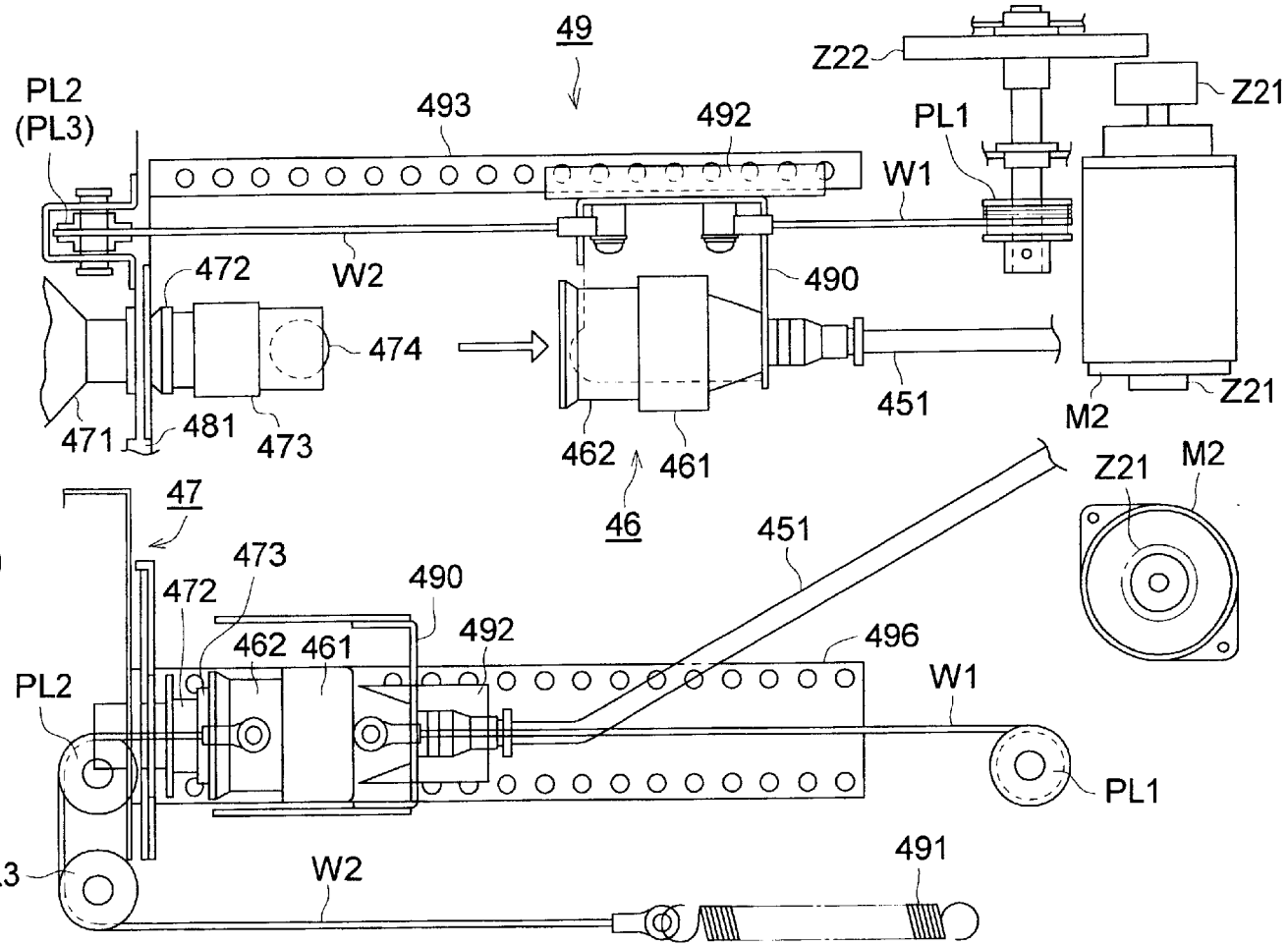
FIG. 15 ( a )
FIG. 15 ( b )

FIG. 16 ( a )
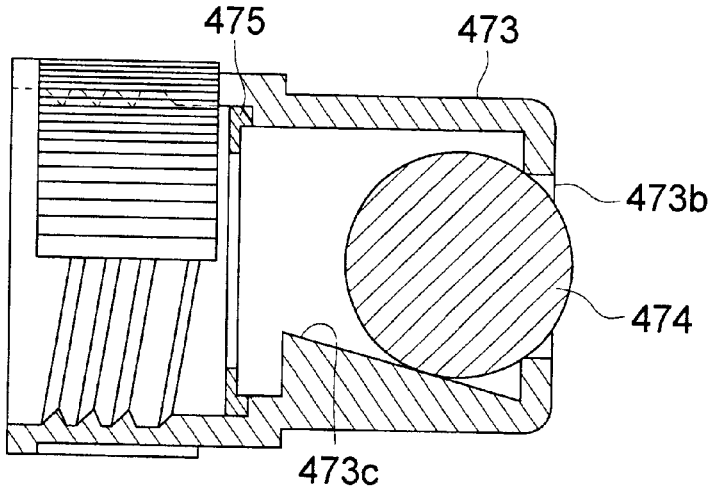
FIG. 16 ( b )
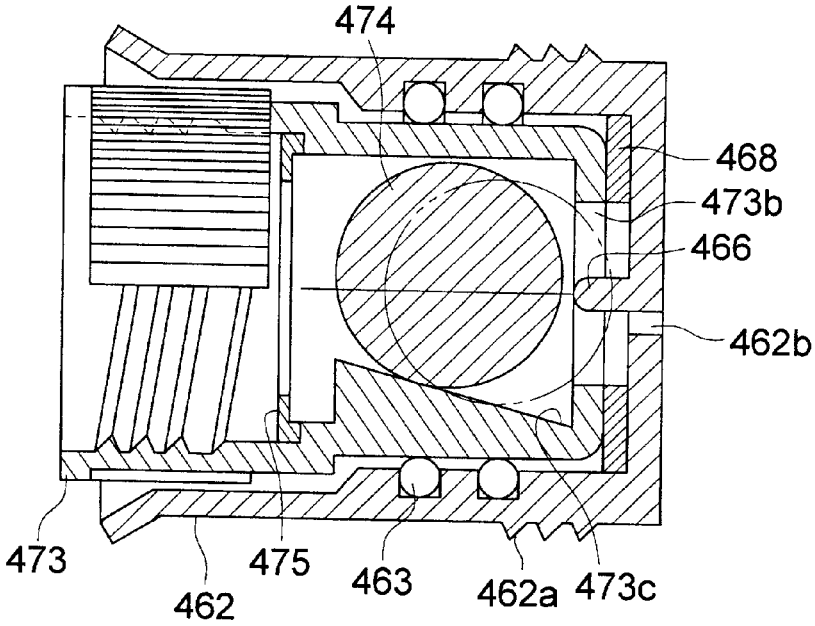

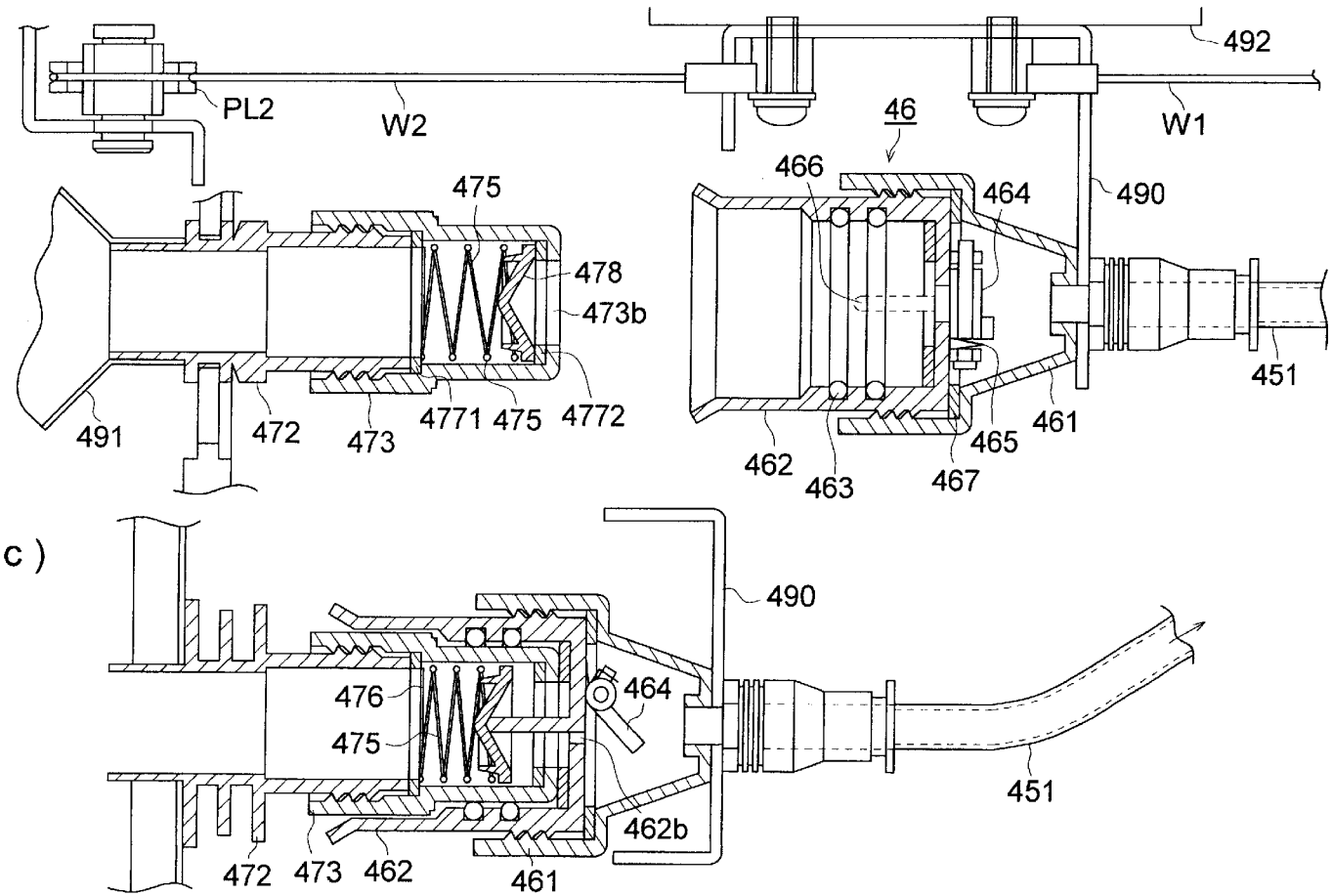
FIG. 17 ( a )
FIG. 17 ( b )
FIG. 17 ( c )

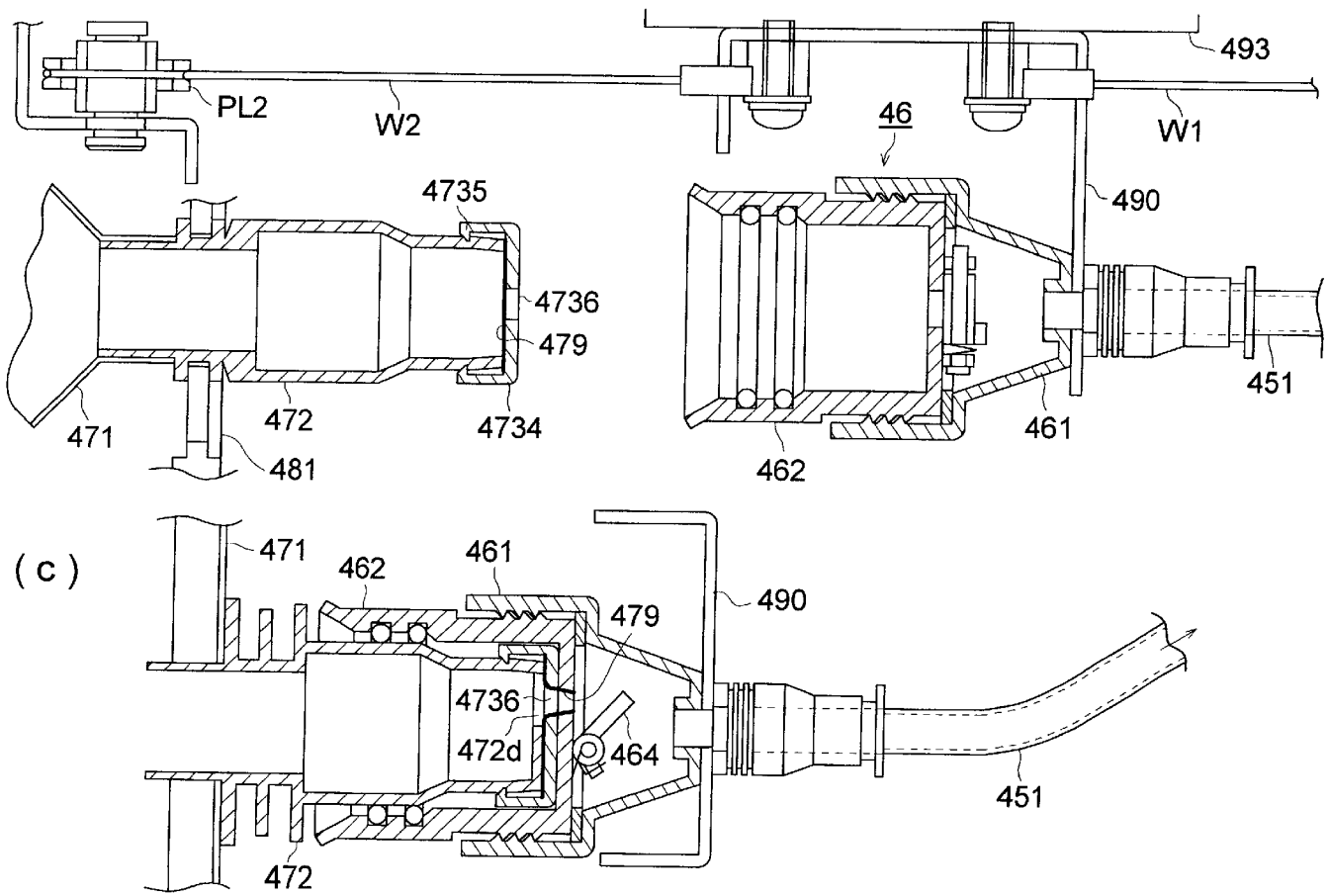
FIG. 22 ( a )
FIG. 22 ( b )
FIG. 22 ( c )

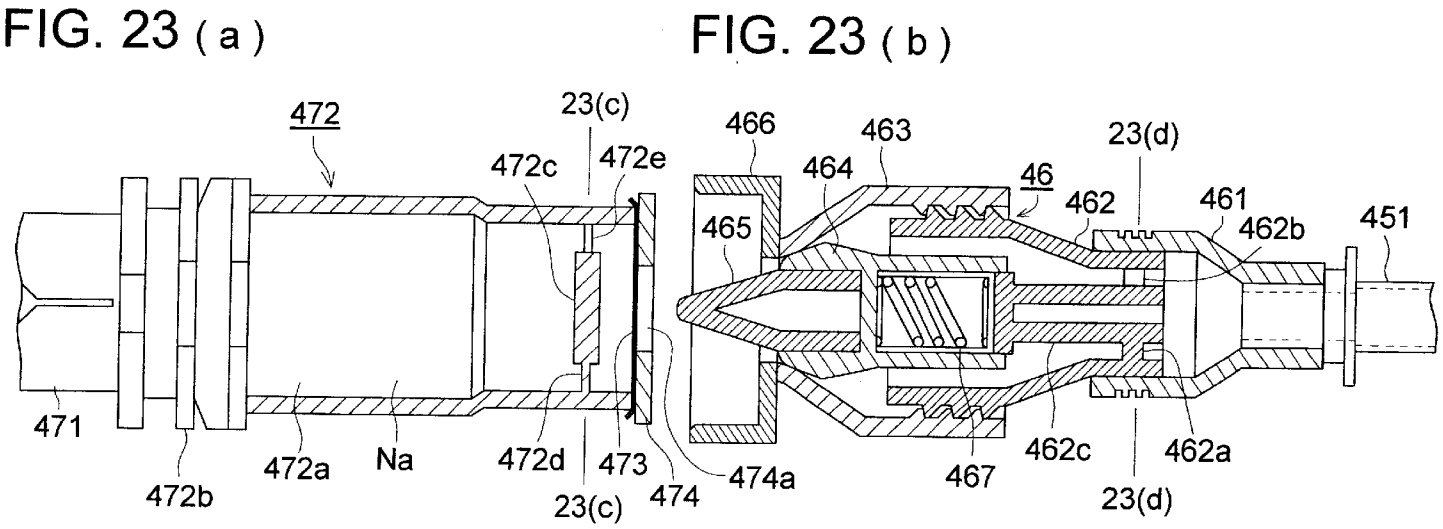
FIG. 23 ( a )
FIG. 23 ( b )
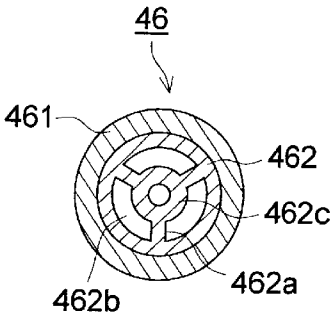
FIG. 23 ( d )
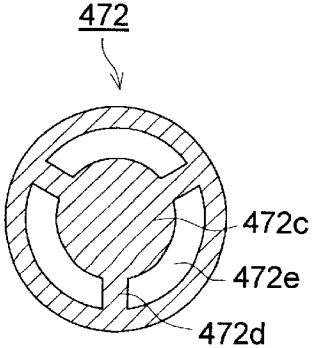
FIG. 23 ( c )

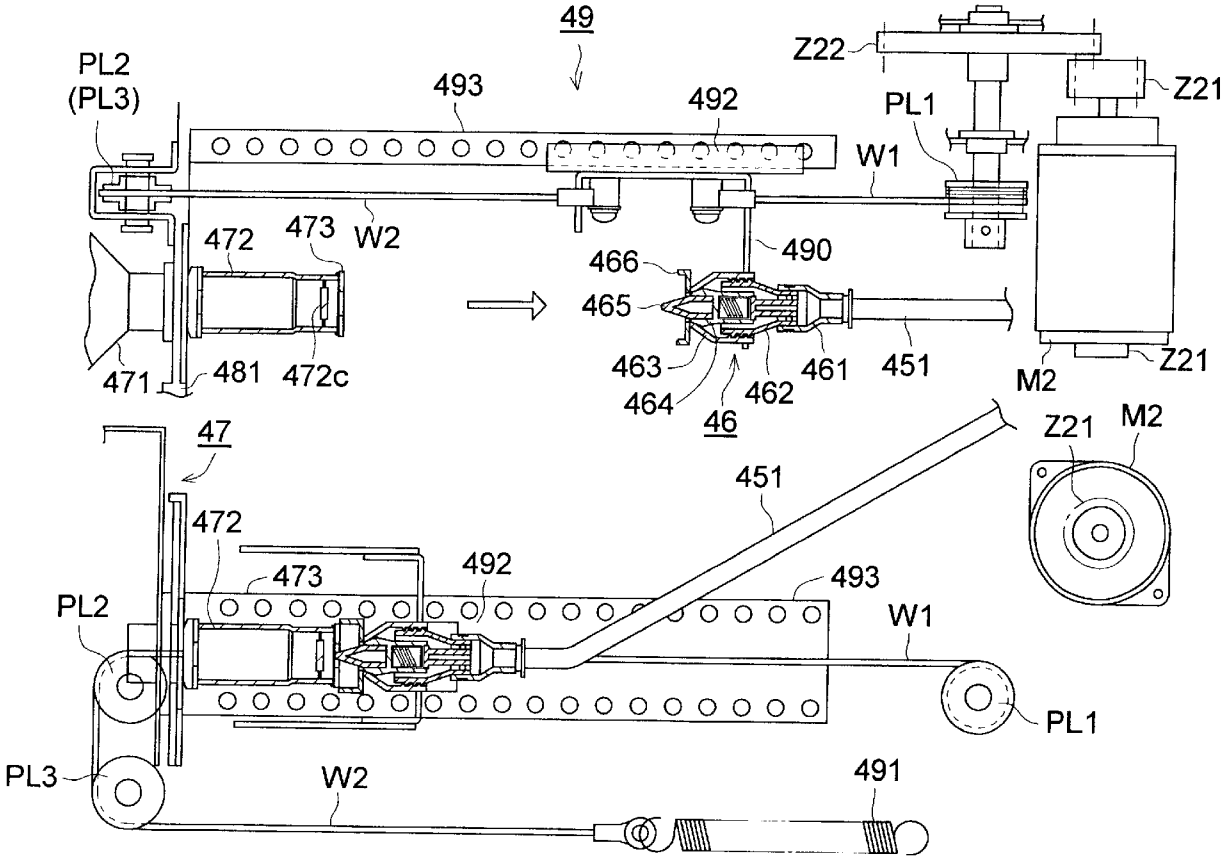
FIG. 24 ( a )
FIG. 24 ( b )

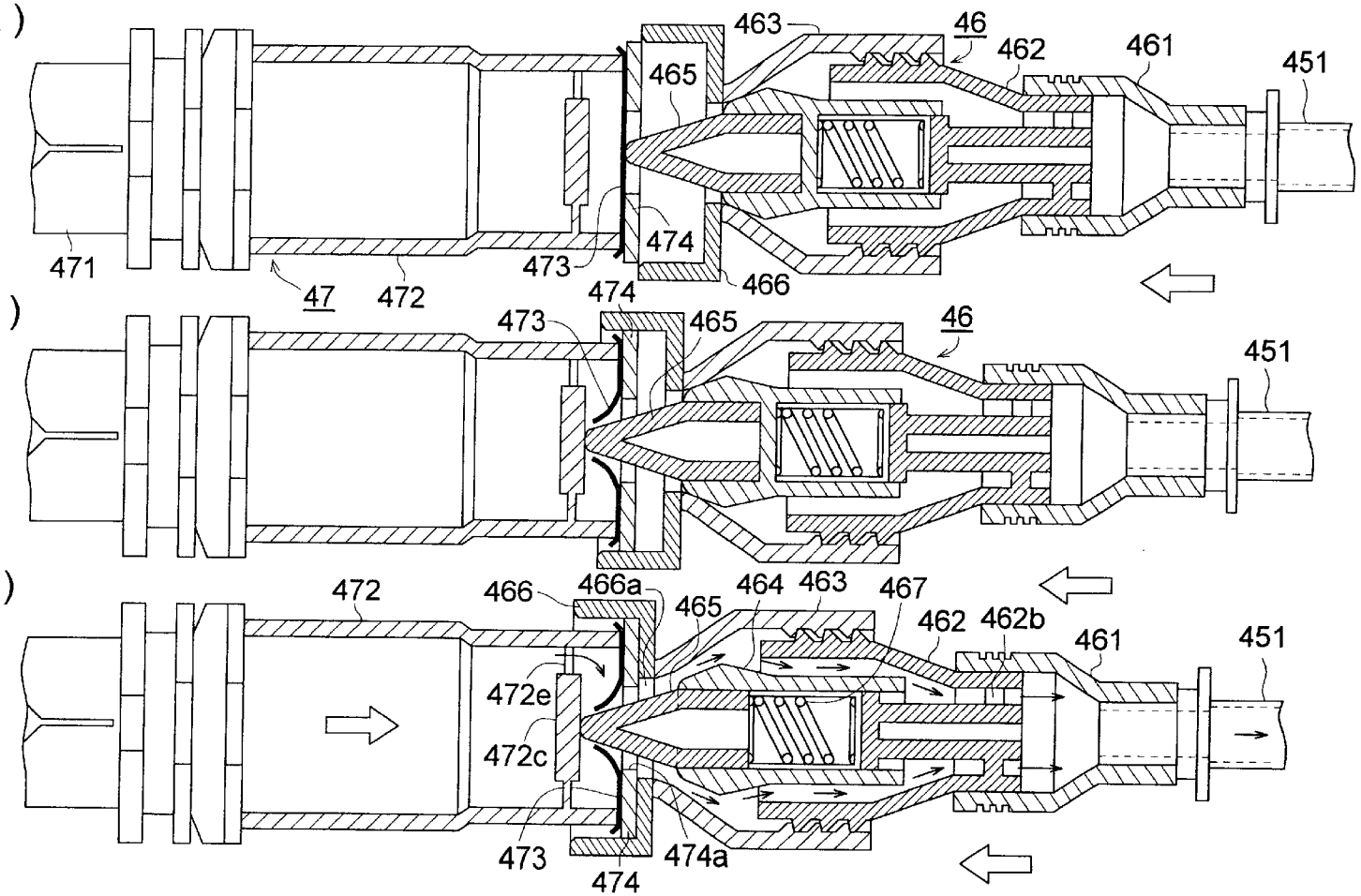
FIG. 25 ( a )
FIG. 25 ( b )
FIG. 25 ( c )

FIG. 28 ( a )
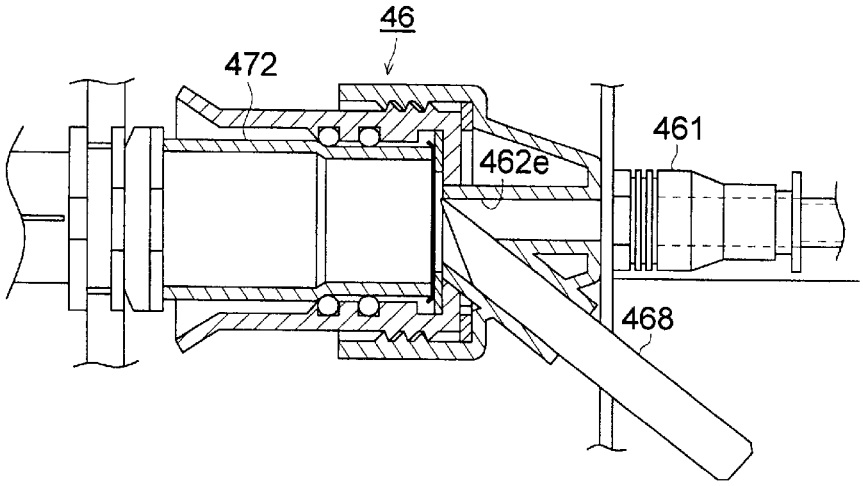
FIG. 28 ( b )
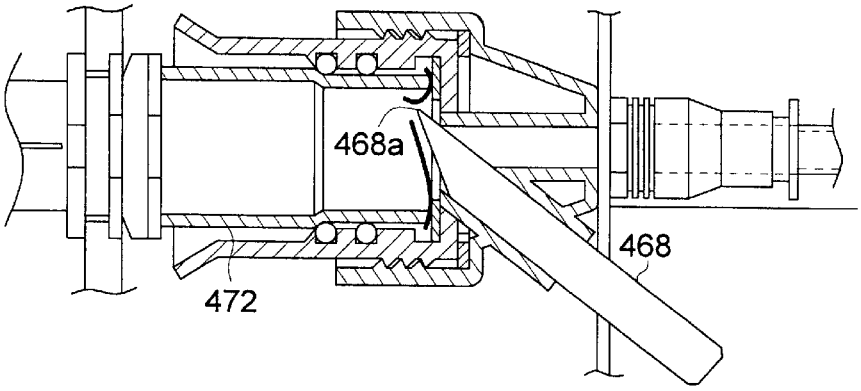
FIG. 28 ( c )
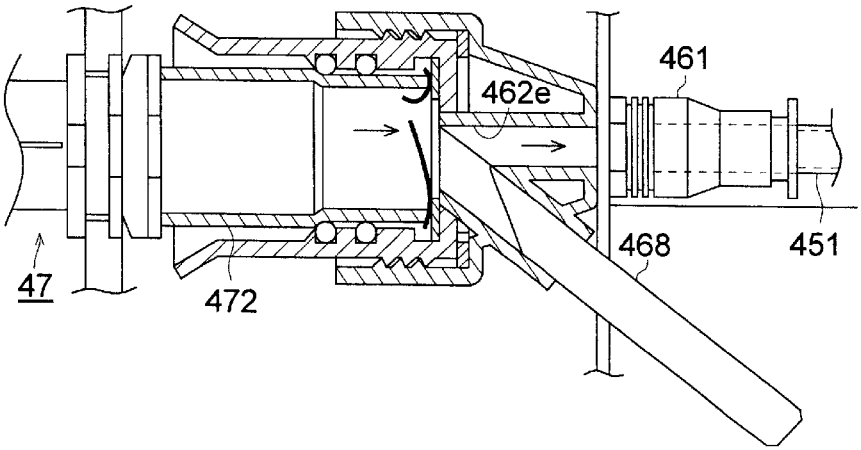

GLUING DEVICE, BOOKBINDING APPARATUS WITH THE GLUING DEVICE AND IMAGE FORMING APPARATUS WITH BOOKBINDING APPARATUS

BACKGROUND OF THE INVENTION

The present invention relates to a gluing device that applies a glue in a strap shape on an edge portion of a sheet that has been subjected to image forming processing and has been ejected out of an image forming apparatus while the sheet is being conveyed, a glue supply method to supply glue in a glue container to a glue discharging means, a glue supply device, a bookbinding apparatus with a gluing device and an image forming apparatus with a bookbinding apparatus.

In recent years, there has been offered a bookbinding apparatus with a gluing device wherein glue is applied for bookbinding at a prescribed position on a sheet on which an image has been recorded by a main body of an image forming apparatus such as a copying machine, a printer and a hybrid machine including the copying machine and printer.

A bookbinding apparatus with a gluing device that is presently used includes (1) a device to discharge glue on a sheet by the use of a glue discharging nozzle, (2) a device wherein a glue wheel is provided on a glue-containing box and glue is stuck to an outer circumferential surface of the rotating glue wheel so that the outer circumferential surface of the glue wheel may be brought into contact with a sheet for contact-transfer and (3) a hot melt coating device wherein a mixture of a hot melt agent (thermo-fusion agent) and heated and compressed air is discharged from a nozzle.

In a bookbinding apparatus disclosed in TOKUHYOSHOO No. 59-500907, with regard to a sheet conveyed in the first conveyance direction, the conveyance direction therefor is changed to the second conveyance direction that is perpendicular to the first conveyance direction, and then, glue is coated on an edge of the running sheet linearly so that sheets are pressurized and bound after being stacked and trued up.

In the gluing method and gluing device disclosed in TOKKAIHEI No. 7-80377, glue discharged from a glue-discharging nozzle is subjected to spraying of high pressure air to turn into a thin film.

A conventional supply device that is used presently and supplies glue to a glue-discharging means having a glue-discharging nozzle includes (1) a supply device wherein glue contained in a glue container is force-fed by compressed air and (2) a supply device wherein glue contained in a glue container is force-fed by a micro-gear pump.

The glue supply device and the bookbinding apparatus with a gluing device both described above have the following problems.

(A) When external pressures are applied on a glue container in the course of storage of the glue container, glue in the glue container leaks out of an ejection opening.

(B) In the course of replacement of the glue container, glue in the glue container leaks out of an ejection opening.

(C) In the course of replacement of the glue container, air enters through an ejection opening to generate glue discharge failure caused by glue supply failure.

A first object of the invention is to solve the problems stated above, to improve a glue supply device of a bookbinding apparatus with a gluing device and to attain easy maintenance work, low noise and down-sizing all for a glue supply device, and thereby to provide a gluing device attaining automation of the glue supply device, the bookbinding apparatus with a gluing device and an image forming apparatus equipped with the bookbinding apparatus with a gluing device.

Further, the glue supply device in the bookbinding apparatus with a gluing device stated above has the following problems.

(D) In the course of replacement of the glue container, when the glue ejection opening of the glue container is connected with a connection means connected to a supply tube that is connected to the glue discharging means, glue in the glue container leaks out of the connection means.

(E) The structure of the connection means that prevents leakage of glue in the course of replacement of the glue container turns out to be complicated. Further, operations for replacement of the glue container becomes complicated, resulting in occurrence of glue leakage and glue supply failure caused by erroneous operations.

A second object of the invention is to solve the problems stated above, to improve a glue supply device of a bookbinding apparatus with a gluing device and to attain prevention of glue leakage in the course of replacement of the glue container of the glue supply device, easy operations for replacement of the glue container, simplification of the structure of the connection means and stabilization of glue supply, and thereby to provide a glue supply device attaining automation thereof, the bookbinding apparatus with a gluing device and an image forming apparatus equipped with the bookbinding apparatus with a gluing device.

SUMMARY OF THE INVENTION (1) The problems (A), (B) and (C) stated above can be solved by a gluing device described in either one of the following Structures 1, 2, 3, 4 and 5 of the invention.

Structure 1: A gluing device having therein a pressuring means which presses a glue container containing liquid glue to eject contained glue from an ejection opening, a supply tube through which the ejected glue is transported from the glue container, a connecting means on the glue container side which connects the supply tube to the glue container, a connecting means on the supply tube side which detachably connects the connecting means on the glue container side to the supply tube, and a glue discharging means which receives the glue transported through the supply tube and delivers them from a nozzle opening, wherein there is provided a valve member provided inside the connecting means on the glue container side that makes the ejection opening to be opened and closed, and a protrusion is provided inside the connecting means on the supply tube side so that the protrusion presses the valve member to open the ejection opening when the connecting means on the supply tube side is connected to the connecting means on the glue container side.

Structure 2: A gluing device having therein a pressuring means which presses a glue container containing liquid glue to eject contained glue from an ejection opening, a supply tube through which the ejected glue is transported from the glue container, a connecting means on the glue container side which is connected to the glue container, a connecting means on the supply tube side which is connected to the connecting means on the glue container side detachably and is connected to the supply tube, and a glue discharging means which receives the glue transported through the supply tube and discharges them from a nozzle opening, wherein there is provided a valve member which is moved by gravity on an inclined face formed on an inner wall of the connecting means on the glue container side to close the ejection opening, and inside the connecting means on the supply tube side, there is provided a protrusion which presses the valve member to open the ejection opening when the connecting means on the supply tube side is connected to the connecting means on the glue container side.

Structure 3: A gluing device having therein a pressuring means which presses a glue container containing liquid glue to eject contained glue from an ejection opening, a supply tube through which the ejected glue is transported from the glue container, a connecting means on the glue container side which is connected to the glue container, a connecting means on the supply tube side which is connected to the connecting means on the glue container side detachably and is connected to a receiving portion of the supply tube, and a glue discharging means which receives the glue transported through the supply tube and discharges them from a nozzle opening, wherein the connecting means on the glue container side is provided with a first connection member that is connected to the ejection opening of the glue container, a valve member that is arranged inside the first connection member and has, on its tip portion, a cone portion, a second connection member that closes a glue flowing path with a cone surface which engages with the cone portion of the valve member and with a moving means that moves the second connection member, and the moving means moves the second connection member of the connecting means on the glue container side to separate the cone portion of the valve member from the cone surface of the second connection member and thereby to enable glue in the glue container to be supplied to the glue discharging means, interlocking with operations for connecting the connecting means on the supply tube side to the connecting means on the glue container side.

Structure 4: A gluing device having therein a pressuring means which presses a glue container containing liquid glue to eject contained glue from an ejection opening, a supply tube through which the ejected glue is transported from the glue container, a connecting means on the glue container side which is connected to the glue container, a connecting means on the supply tube side which is connected to the connecting means on the glue container side detachably and is connected to a receiving portion of the supply tube, and a glue discharging means which receives the glue transported through the supply tube and discharges them from a nozzle opening, wherein the connecting means on the glue container side is provided with a connection member that is connected to the ejection opening of the glue container, an elastic valve member that enables the ejection opening to be opened and closed, and an urging member that urges the elastic valve member to close the ejection opening, and inside the connecting means on the supply tube side, there is provided a protrusion which presses the elastic valve member to open the ejection opening when the connecting means on the supply tube side is connected to the connecting means on the glue container side.

Structure 5: A gluing device having therein a pressuring means which presses a glue container containing liquid glue to eject contained glue from an ejection opening, a supply tube through which the ejected glue is transported from the glue container, a connecting means on the glue container side which is connected to the glue container, a connecting means on the supply tube side which is connected to the connecting means on the glue container side detachably and is connected to a receiving portion of the supply tube, and a glue discharging means which receives the glue transported through the supply tube and discharges them from a nozzle opening, wherein the connecting means on the glue container side is formed in a double-structure shape including a membrane member that closes the ejection opening of the glue container and is capable of being opened and closed and an outer cover member that protects the membrane member and has an opening which agrees positionally with the ejection opening when it is rotated, and after the ejection opening of the glue container and the opening of the outer cover member are made to agree with each other, the connecting means on the supply tube side is connected to the connecting means on the glue container side, and pressure is given by the pressuring means so that the membrane member may be ruptured by pressure of the glue in the glue container, thus the glue in the glue container is supplied to the glue discharging means.

(2) A bookbinding apparatus with a gluing device of the invention is characterized to be provided with the gluing device described in Structure 1 above, a housing means wherein a plurality of sheets subjected to glue-coating processing by the gluing device are housed to be arranged and a pressuring means that applies pressure on glue-coated portions of the arranged plural sheets.

(3) An image forming apparatus with a bookbinding apparatus is characterized to be provided with an image forming apparatus main body composed of an image writing means, an image forming means and a sheet conveyance means and with the bookbinding apparatus with a gluing device described in item (2) above.

(4) The problems (D) and (E) stated above can be solved by a glue supply method described in Structure 6 or Structure 7.

Structure 6: A glue supply method for supplying glue ejected from a glue ejection opening of a capsule member that is connected to a flexible bag object containing liquid glue to a glue discharging means through a connecting means and a supply tube, wherein when the connecting means is advanced to be connected to the capsule member, a projected tip portion of a projection member fixed on a movable valve member that enables a glue-receiving opening of the connecting means to be opened and closed breaks through an inner cover that covers the glue ejection opening of the capsule member to open the glue ejection opening, and when the connecting means is further advanced, the projected tip portion comes in contact with a stop portion of the capsule member to make the movable valve member to retreat, and thereby, the glue receiving opening of the connecting means is opened.

Structure 7: A glue supply method for supplying glue ejected from a glue ejection opening of a capsule member that is connected to a flexible bag object containing liquid glue to a glue delivery means through a connecting means and a supply tube, wherein after the glue receiving opening of the connecting means and the glue ejection opening of the capsule member are made to agree with each other by advancing the connecting means and thereby connecting to the capsule member, a movable breaking member provided in the vicinity of the glue receiving opening of the connecting means is advanced by a driving means, and thereby an inner cover that covers a glue ejection opening of the capsule member is broken by a projected tip portion of the movable breaking member so that the glue ejection opening is opened.

(5) The problems (D) and (E) stated above can be solved by the glue supply device described in either one of Structures 8, 9 and 10.

Structure 8: A glue supply device having therein a glue container containing liquid glue, a pressuring means that presses the glue container to eject glue contained in the glue container, a supply tube through which the glue ejected from the glue container is conveyed, a glue discharging means that receives glue conveyed through the supply tube and discharges them from a nozzle opening, and a connecting means that connects a capsule member of the glue container detachably to the supply tube, wherein the glue container has therein the capsule member, an inner cover that intercepts a part of the glue container and is capable of being broken and a stop portion fixed on the part of the glue container inside the inner cover, while, the connecting means is provided with a connection member having a glue receiving opening that is connected to the supply tube, a movable valve member that is supported movably in the connecting member and makes the glue receiving opening to be capable of being opened and closed, a projection member having a projected tip portion fixed on the movable valve member, and an elastic member that urges the movable valve member, and when the connecting means is advanced to be engaged with the capsule member for the purpose of connecting the connecting means to the glue container, the projected tip portion of the projection member breaks the inner cover to open the part of the glue container, and when the connecting means is further advanced, the projected tip portion comes into contact with the stop portion of the capsule member to make the movable valve member to retreat against urging force of the elastic member and thereby to open the glue receiving opening of the connecting member.

Structure 9: A glue supply device having therein a glue container containing liquid glue, a pressuring means that presses the glue container to eject glue contained in the glue container, a supply tube through which the glue ejected from the glue container is conveyed, a glue discharging means that receives glue conveyed through the supply tube and discharges them from a nozzle opening, and a connecting means that connects a capsule member of the glue container detachably to the supply tube, wherein the glue container has the capsule member and an inner cover that intercepts a part of the glue container and is capable of being broken, while, the connecting means is provided with a connection member having a glue receiving opening that is connected to the supply tube, a movable breaking member having a projected tip portion supported movably in the vicinity of the glue receiving opening of the connection member, and a driving means that drives the movable breaking member, and when the connecting means is advanced by the driving means after the glue receiving opening of the connecting means and the capsule member are made to agree positionally with each other by advancing the connecting means and thereby by connecting the connecting means to the glue container, the inner cover is broken by the projected tip portion of the movable breaking member so that the part of the glue container is opened.

Structure 10: A glue supply device having therein a glue container containing liquid glue, a pressuring means that presses the glue container to eject out glue contained in the glue container, a supply tube through which the glue ejected from the glue container is conveyed, a glue discharging means that receives glue conveyed through the supply tube and discharges them from a nozzle opening, and a connecting means that connects a capsule member of the glue container detachably to the supply tube, wherein the glue container has the capsule member and an inner cover that intercepts a part of the glue container and is capable of being broken, while, the connecting means has therein a connecting member having a glue receiving opening that is connected to the supply tube, a movable breaking member having a projected tip portion supported movably in the vicinity of the glue receiving opening of the connecting member, and a driving means that drives the movable breaking member, and the movable breaking member stops at the position where the glue receiving opening of the connecting means is intercepted, when the glue container and the connecting means leave each other, to prevent glue in the connecting means and the supply tube from flowing out.

(6) A bookbinding apparatus with a gluing device of the invention is characterized to be provided with a glue supply device described in Structure 8, a glue discharging means that receives glue supplied from the glue supply device and discharges them from a nozzle opening, a conveyance means that conveys a sheet subjected to gluing processing conducted by the glue discharging means, a housing means that arranges and houses sheets subjected to the gluing processing, a pressuring means that conducts bookbinding by pressing a bundle of arranged sheets, and with a sheet ejection means that ejects a booklet thus bound.

(7) An image forming apparatus of the invention is characterized to be provided with an image forming apparatus main body composed of an image writing means, an image forming means and a sheet conveyance means and with a bookbinding apparatus with a gluing device described in item (6) above.

Figure 4:
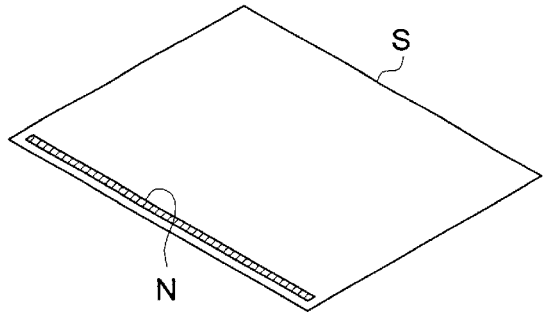
Figure 4:
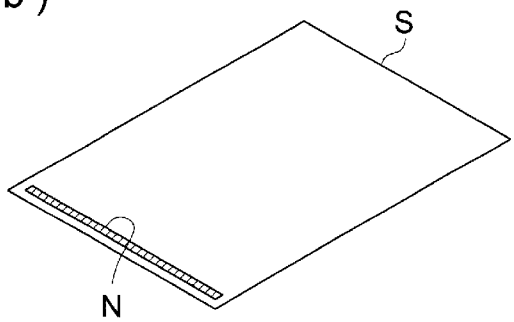
Figure 4:
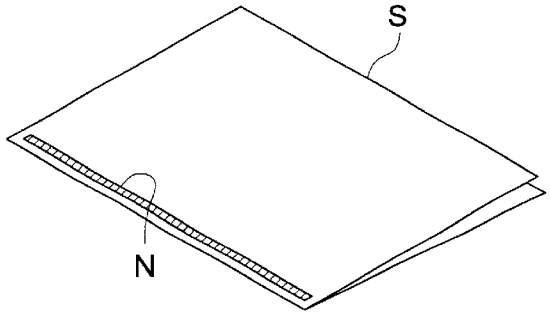
Figure 4:
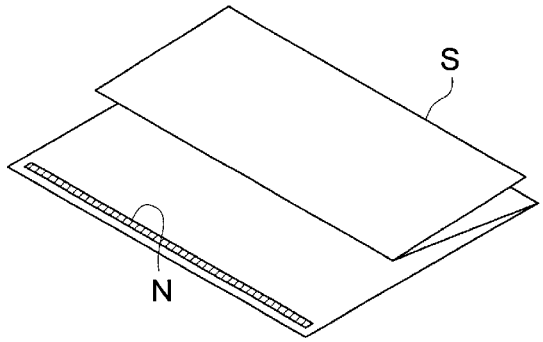

Each of FIGS. 4(*a*)–4(*d*) is a perspective view showing a glue coating position for each type of a sheet.

Figure 5:
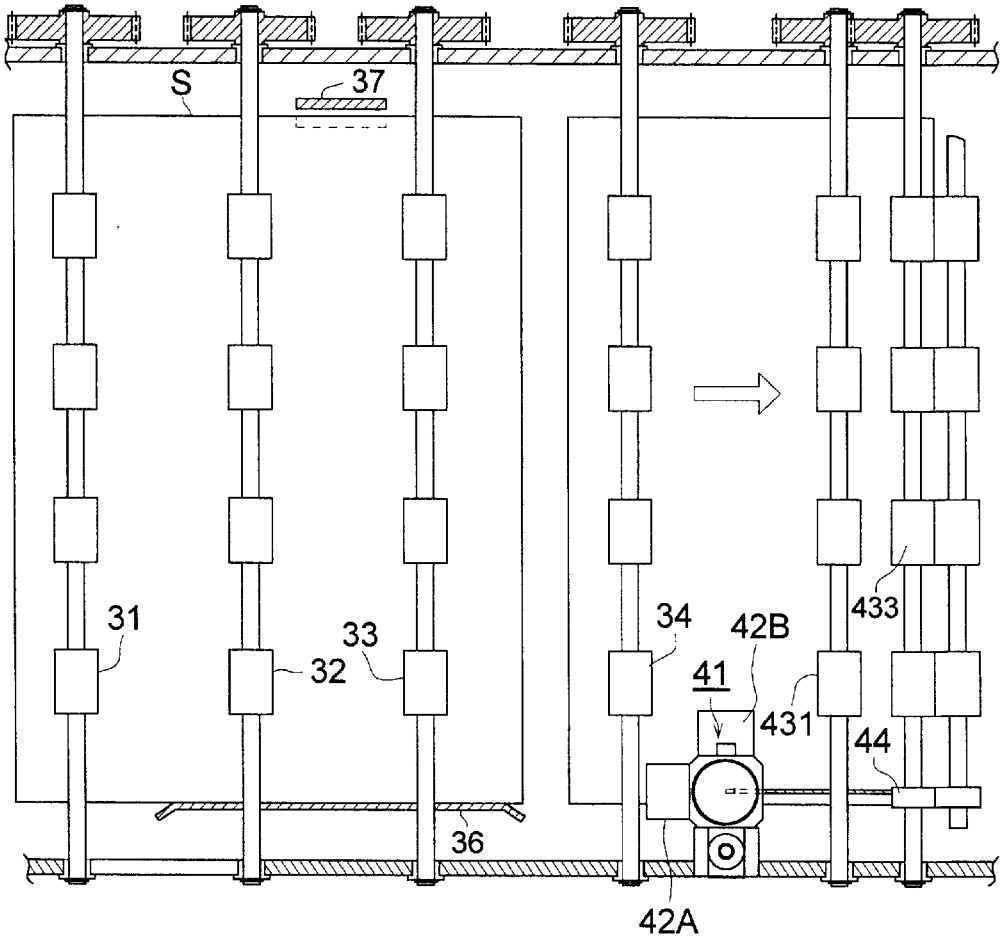
Figure 5:
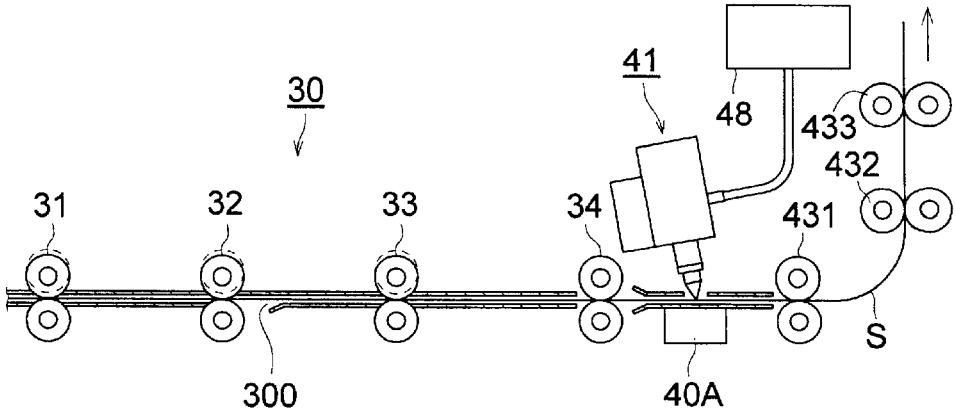

FIGS. 5(*a*) and 5(*b*) represent respectively a top view and a front view both for the vicinity of a sheet correcting means and of a glue discharging means of a glue coating means.

Figure 6:
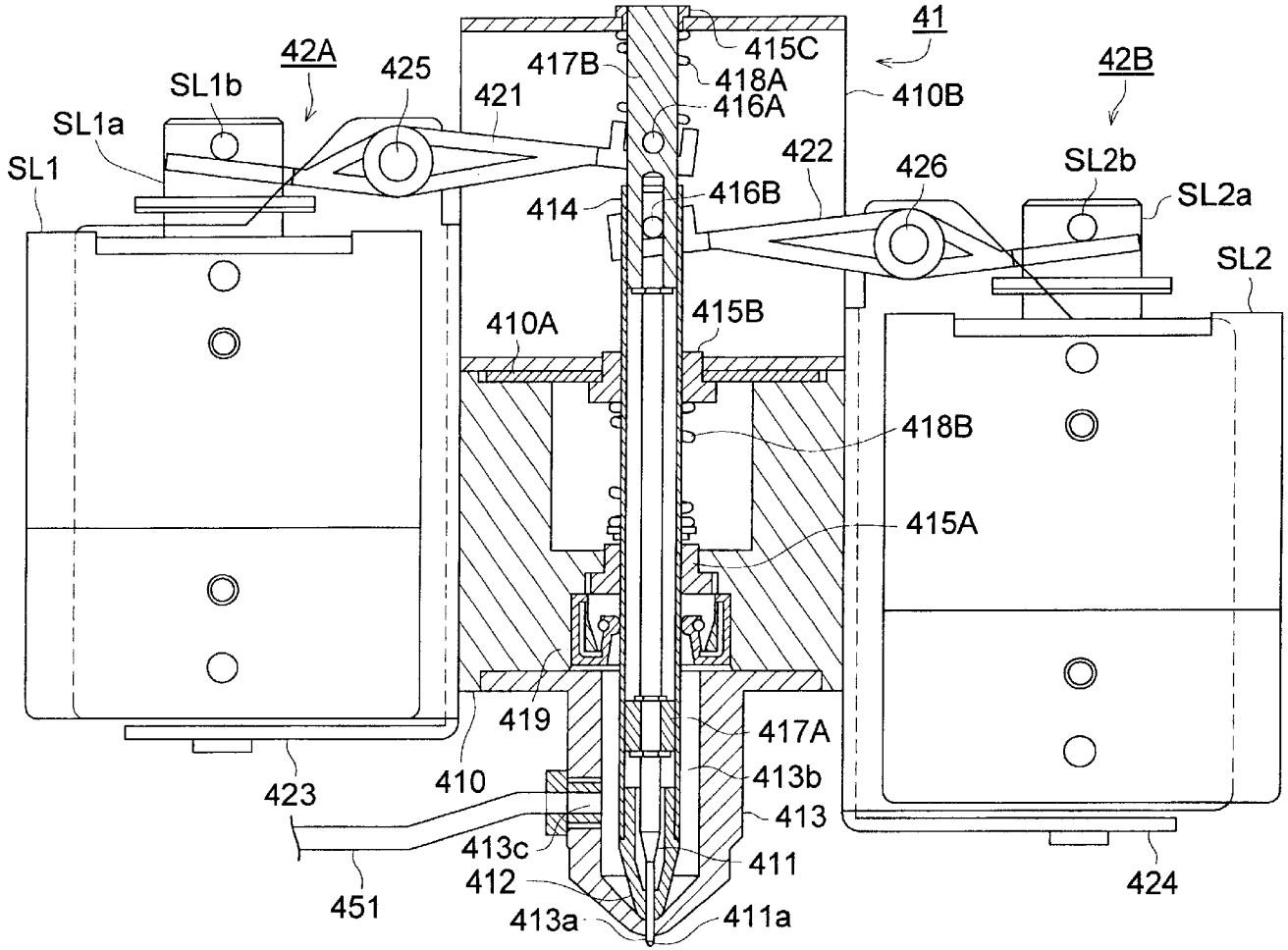

FIG. 6 is an enlarged sectional view of a glue discharging means and a driving means.

Figure 7:
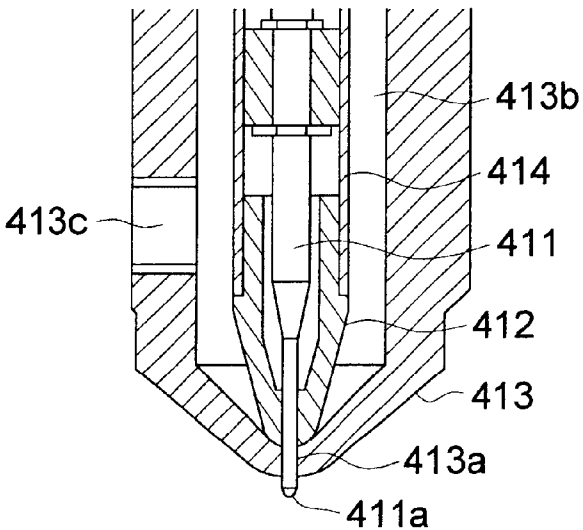
Figure 7:
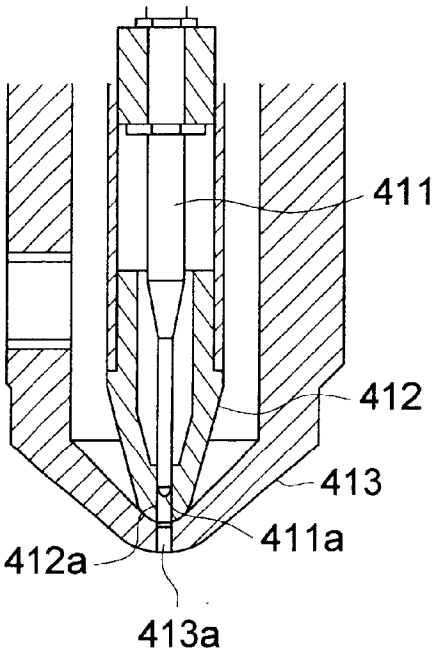
Figure 7:
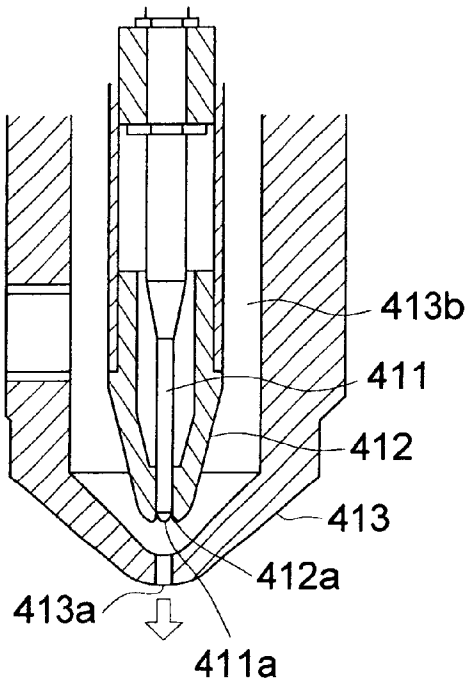

Each of FIGS. 7(*a*)–7(*c*) is an enlarged sectional view showing a process of movement of for both a first needle member and a second needle member.

FIG. 8(*a*) is a perspective view and

FIG. 8(*b*) is a sectional view both of a glue container.

Figure 9:
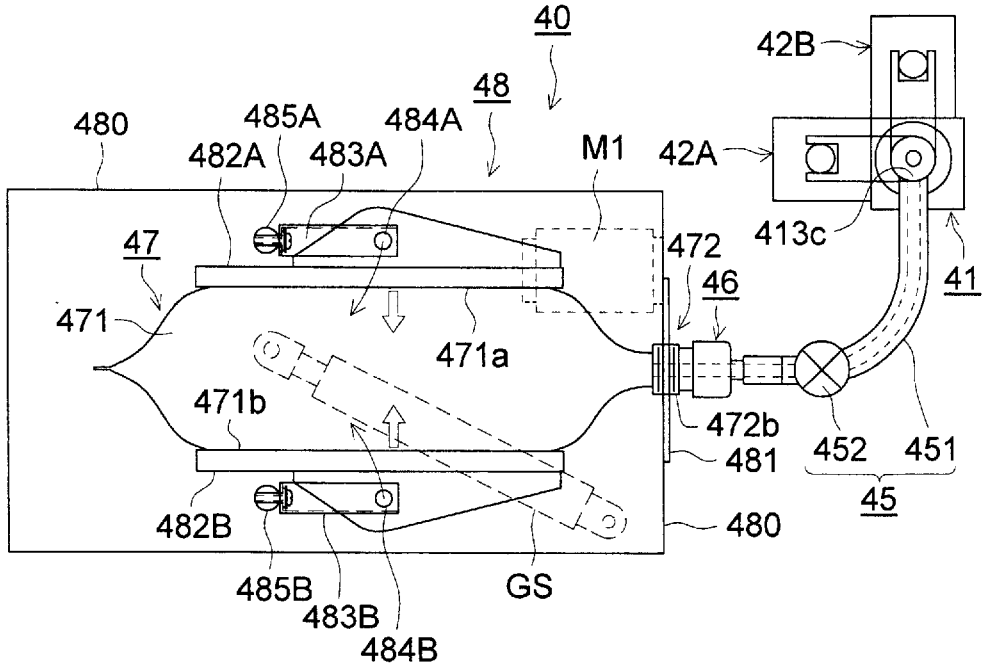
Figure 9:
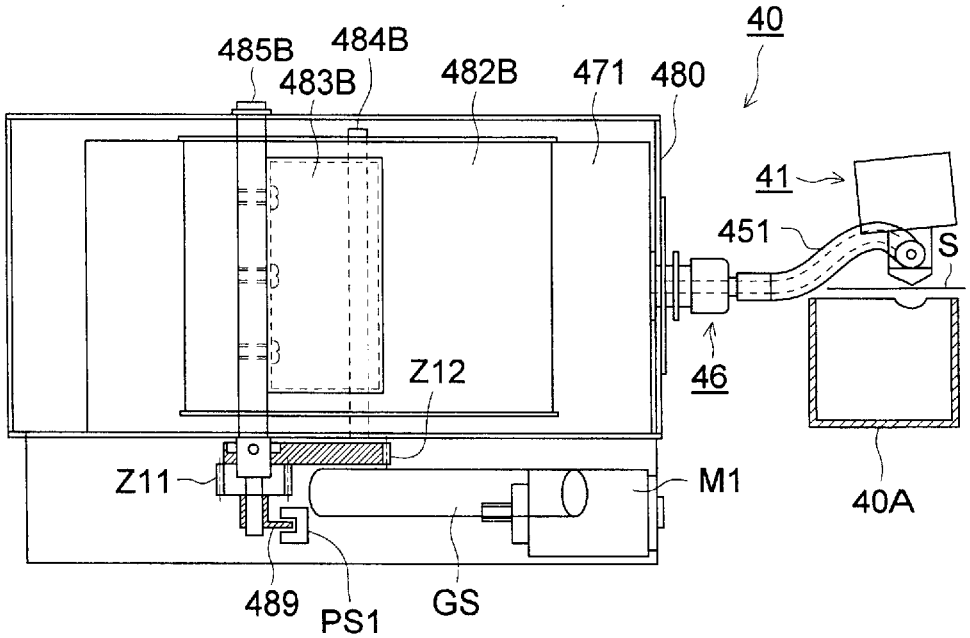

FIG. 9(*a*) is a top view and

FIG. 9(*b*) is a front sectional view both of a glue supply means showing a initial state wherein a glue container is mounted on a glue supply means.

Figure 10:
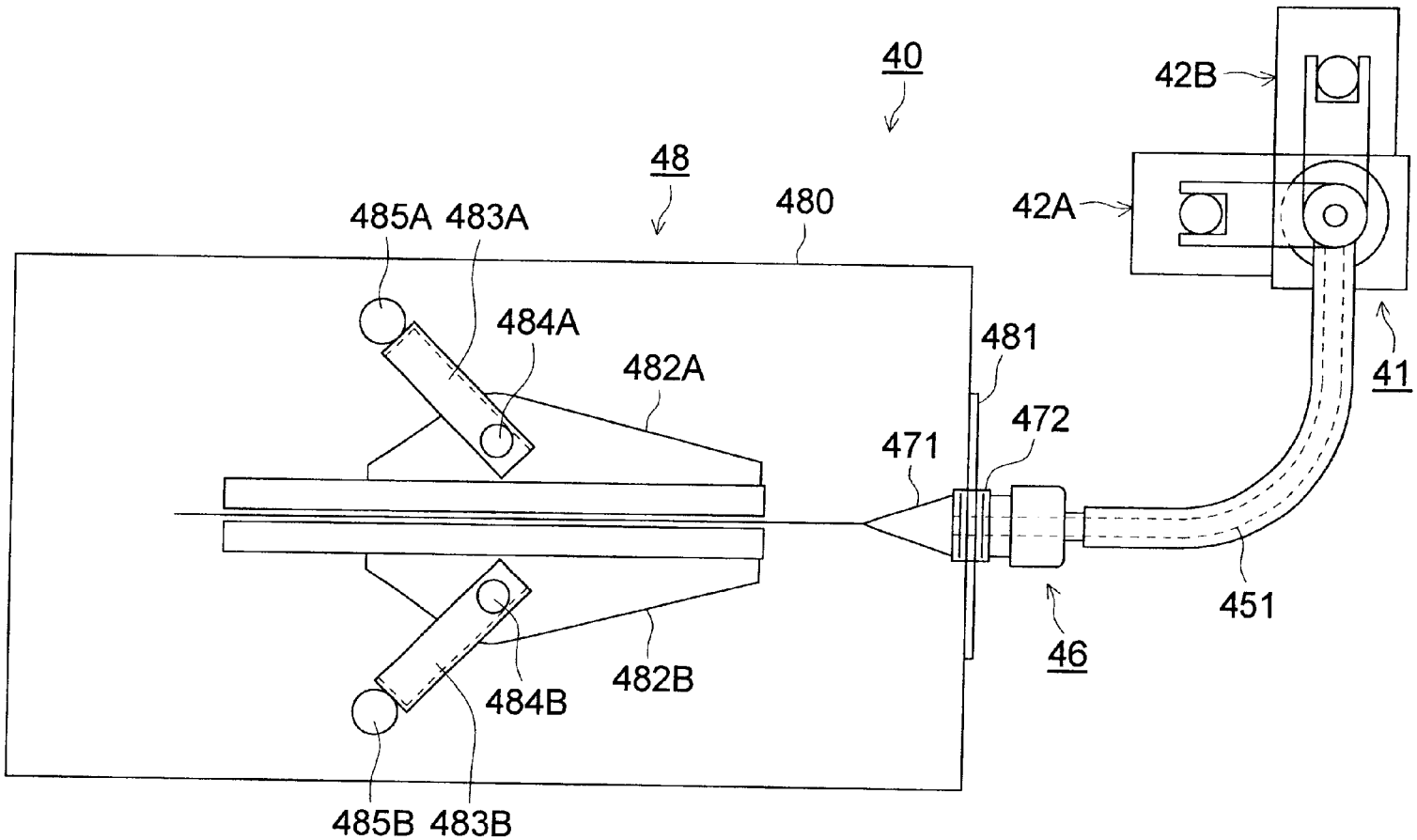

FIG. 10 is a top view of a glue supply means wherein a glue container mounted on a glue supply means is flat.

Figure 11:
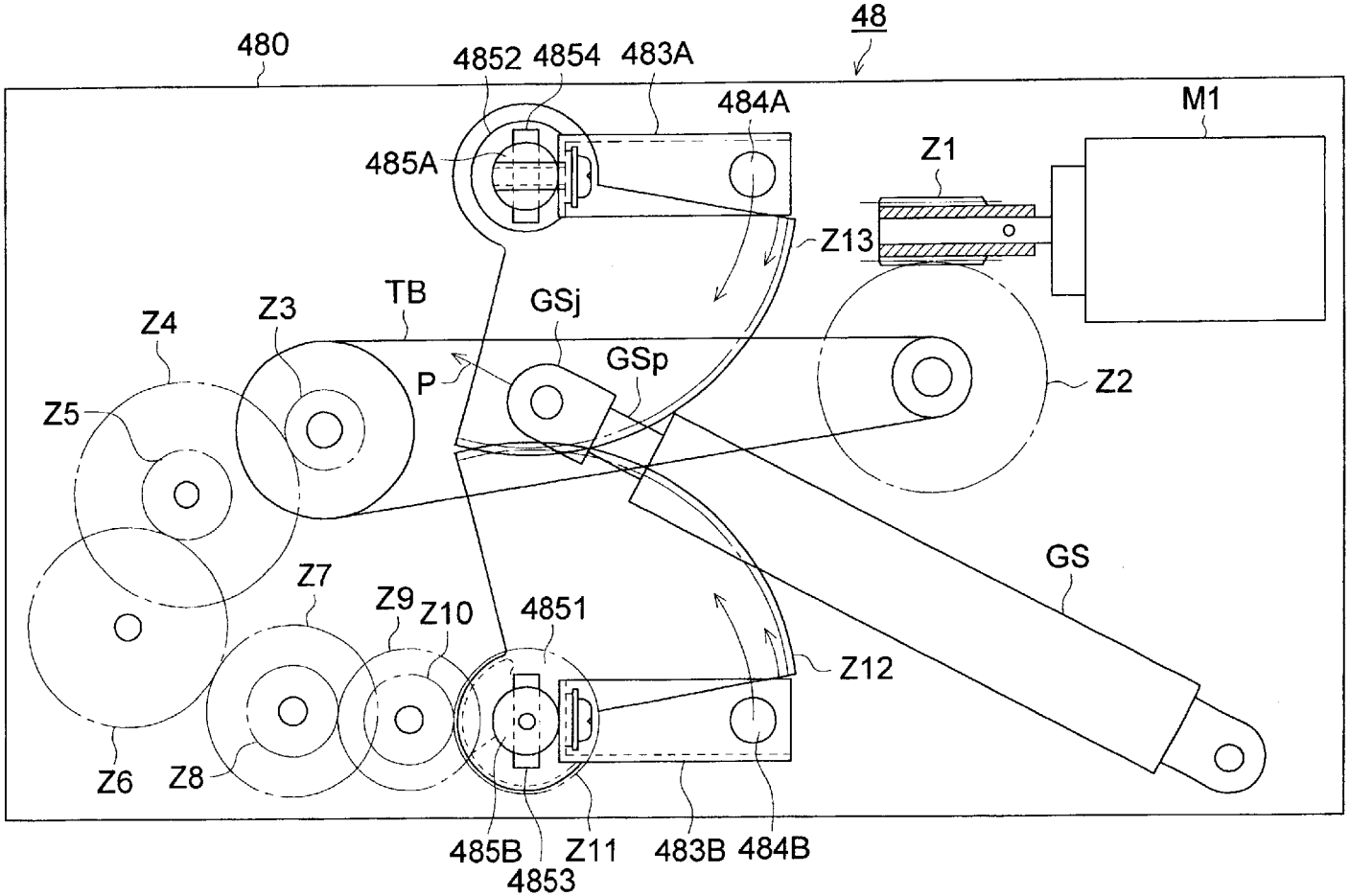

FIG. 11 is a top view of a pressing driving mechanism of a glue supply means.

Figure 12:
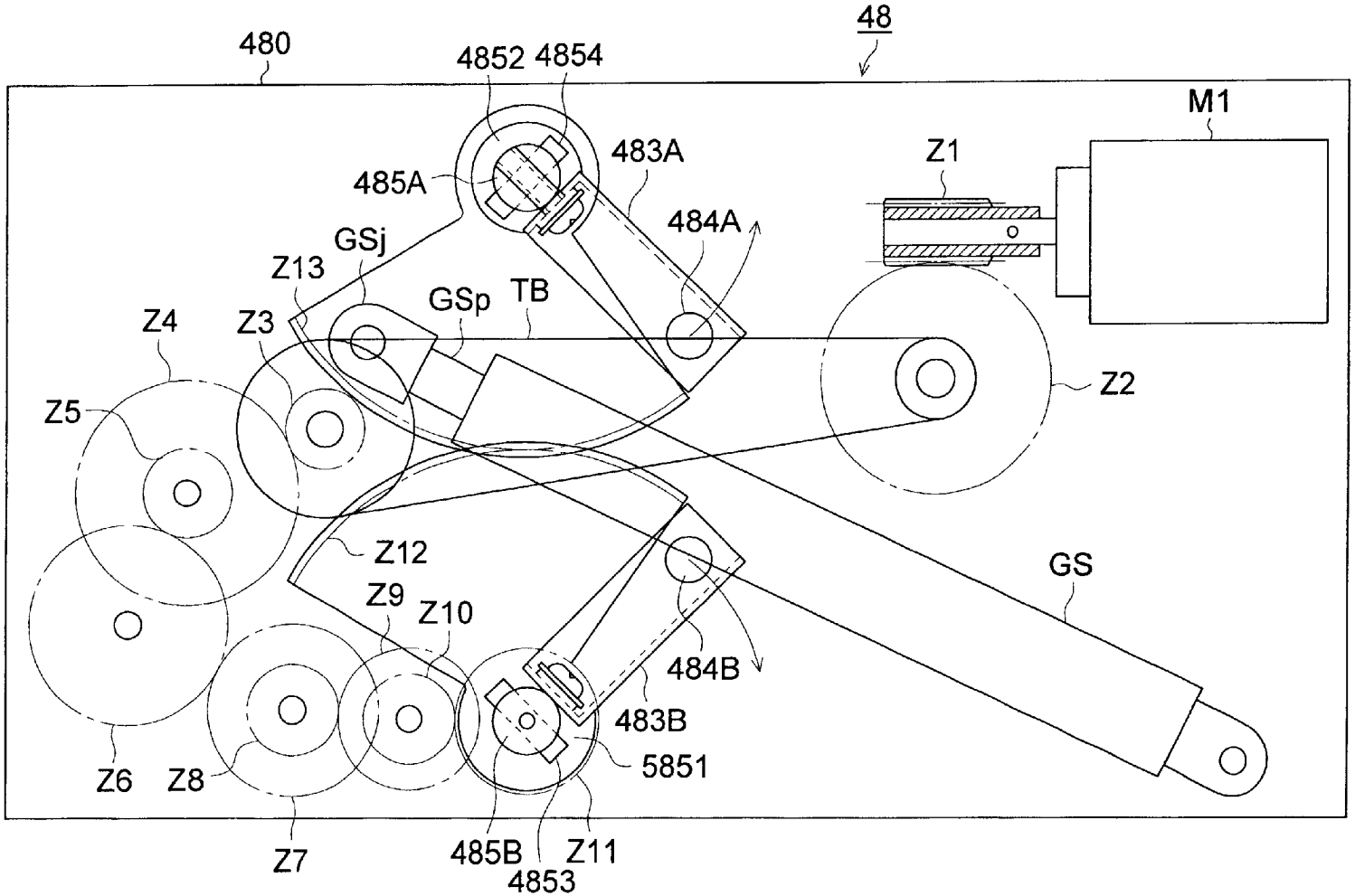

FIG. 12 is a top view of a pressing releasing mechanism of a glue supply means.

FIGS. 13(*a*)–13(*c*) represent sectional views showing respectively the non-contact state and contact state between a connecting means on the supply tube side and a connecting means on the glue container side.

Figure 14:
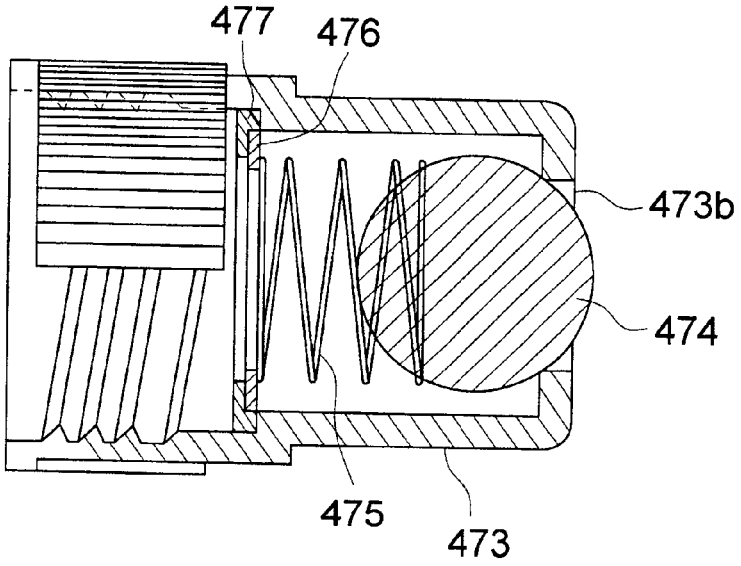
Figure 14:
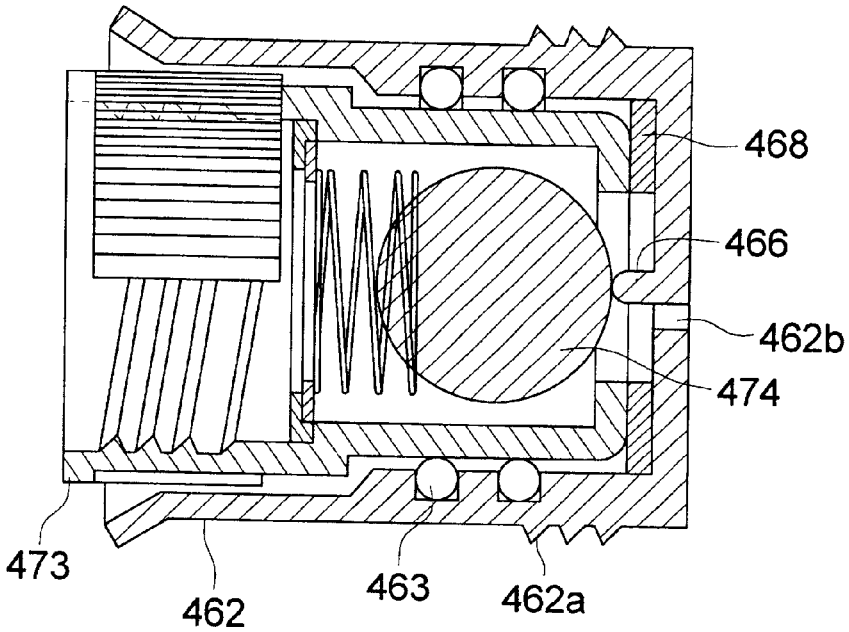

FIGS. 14(*a*)–14(*b*) represent enlarged sectional views of a connecting means on the glue container side respectively for non-supply and supply of glue.

FIG. 15(*a*) is a top view of in the non-contact state and

FIG. 15(*b*) is a front view in the contact state both for a driving means that moves a connecting means on the supply tube side.

FIGS. 16(*a*) and 16(*b*) show a second embodiment of a glue supply means, and represent enlarged sectional views of a connecting means on the glue container side respectively for non-supply and supply of glue.

Figure 18:
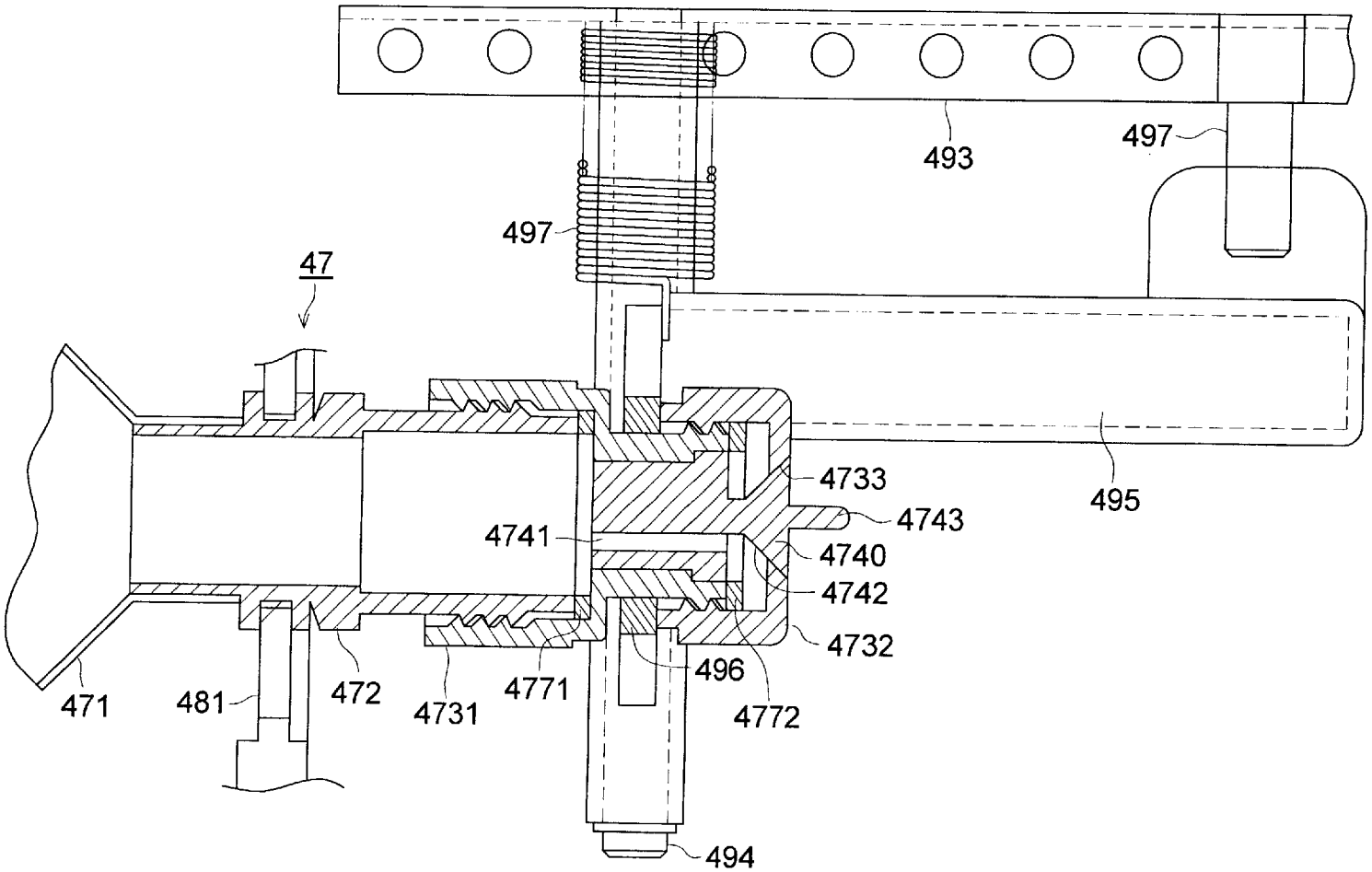

FIGS. 17(*a*)–17(*c*) show a third embodiment of a glue supply means and represent respectively a connecting means on the supply tube side and a connecting means on the glue container side respectively in the non-contact state and contact state FIG. 18 shows a fourth embodiment of a glue supply means and represents a sectional top view of a connecting means on the glue container side.

Figure 19:
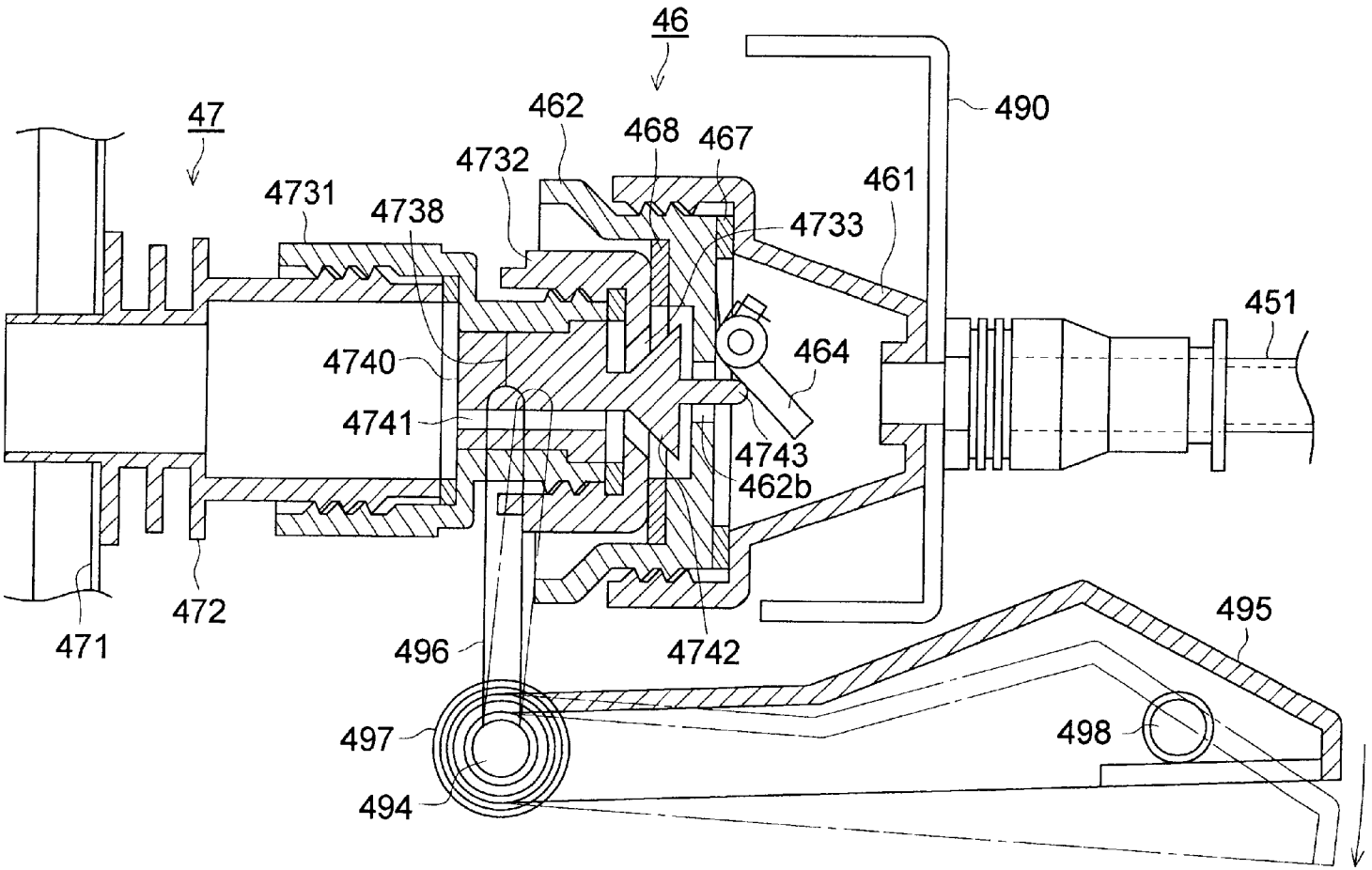

FIG. 19 shows a fourth embodiment of a glue supply means and represents sectional front views of a connecting means on the supply tube side and a connecting means on the glue container side.

Figure 20:
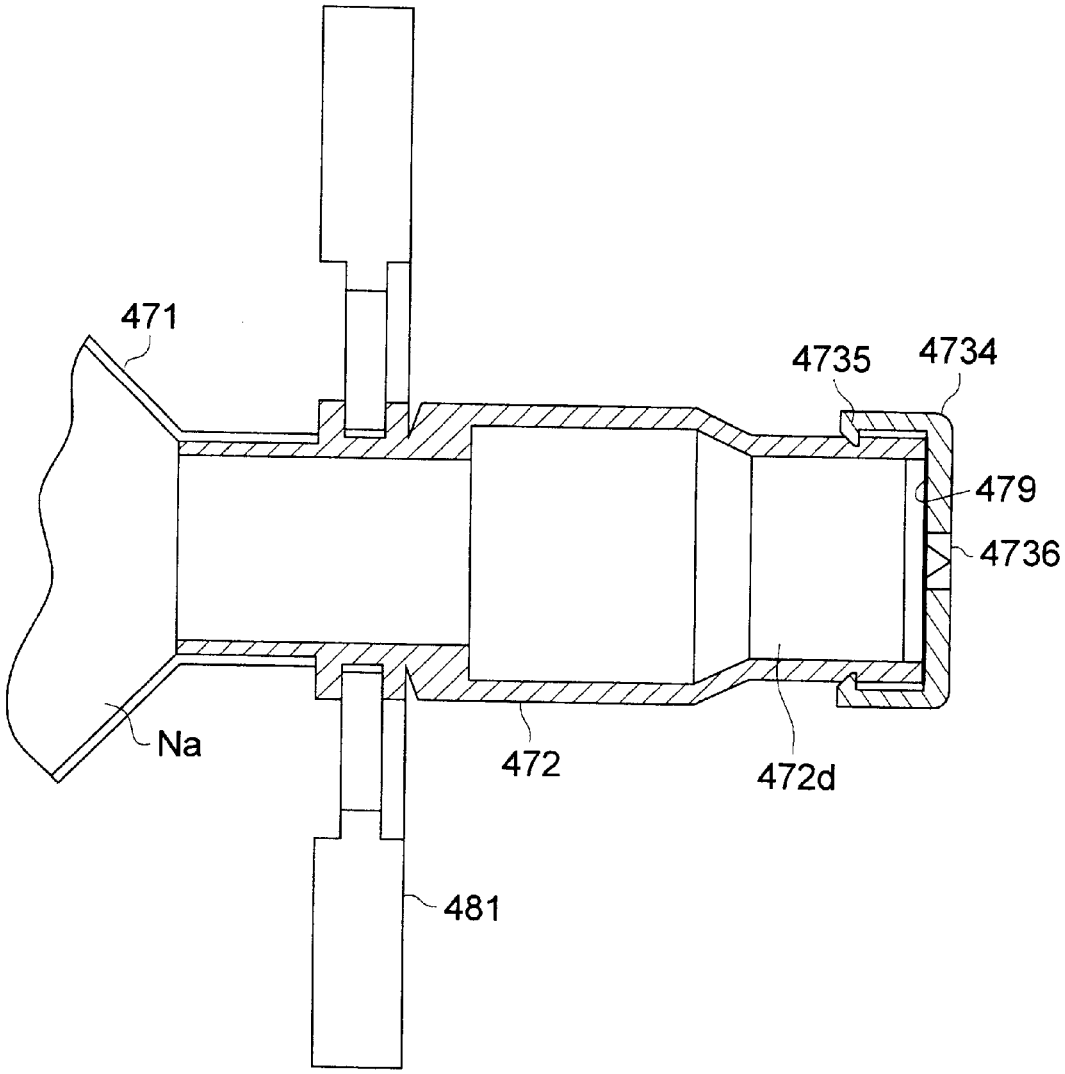

FIG. 20 shows a fifth embodiment of a glue supply means and represents a sectional top view of a connecting means on the glue container side.

Figure 21:
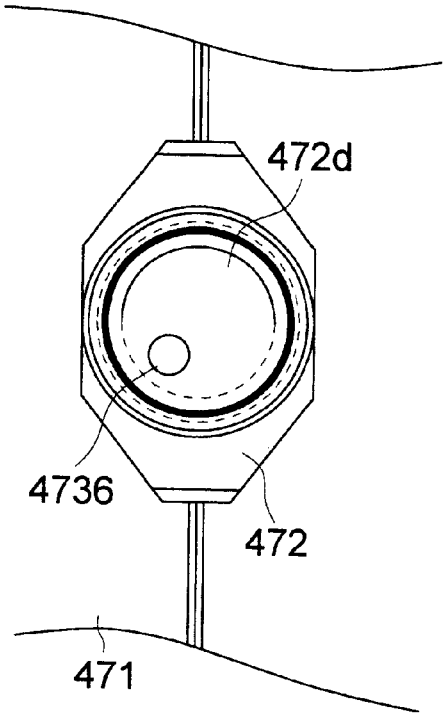
Figure 21:
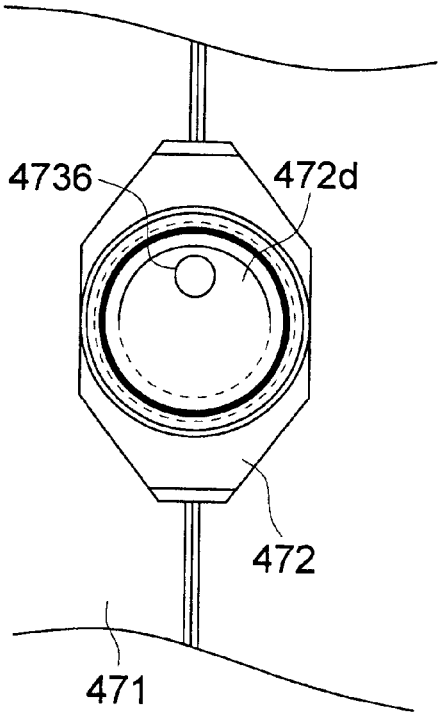

FIGS. 21(*a*) and 21(*b*) show a fifth embodiment of a glue supply means and represent partial side views showing respectively the state where an opening of a connecting means on the glue container side is closed and the state where an opening of a connecting means on the glue container side is opened FIGS. 22(*a*)–22(*c*) show a fifth embodiment of a glue supply means and represent sectional views showing a connecting means on the supply tube side and a connecting means on the glue container side respectively in the non-contact state and the contact state.

FIGS. 23(*a*)–23(*d*) show respectively sectional views of a capsule member of a glue container and a connecting means, 23(*c*)–23(*c*) section of the capsule member and 23(*d*) –23(*d*) section of the connecting means.

FIG. 24(*a*) is a top view of a driving means for moving a connecting means under the non-contact state and FIG. 24(*b*) is a front view of a driving means under the contact state.

FIGS. 25(*a*)–25(*c*) show sectional views showing a process of contact between a capsule member of a glue container and a connecting means.

Figure 26:
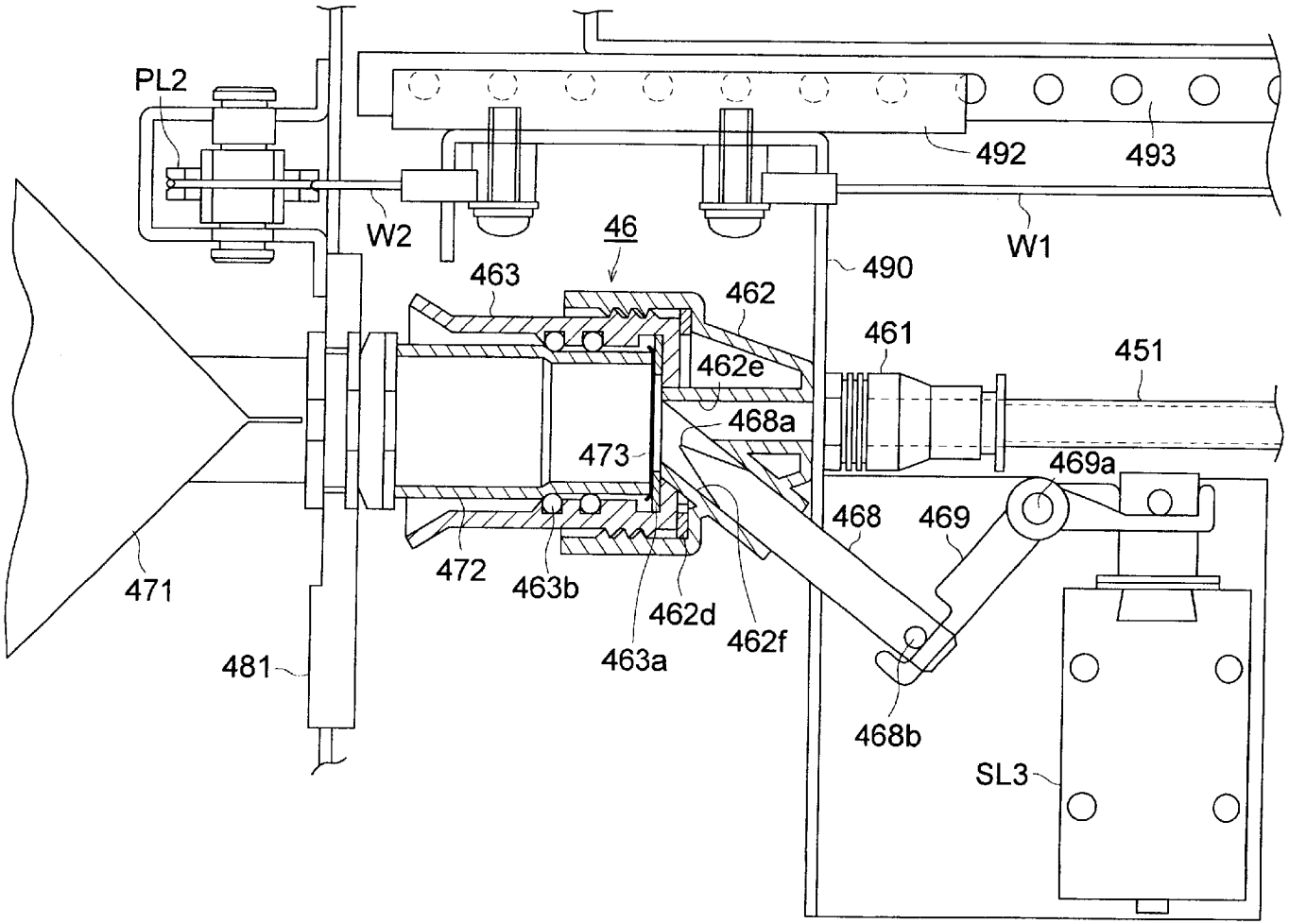

FIG. 26 is a sectional view showing a process of glue supply in the second embodiment of a glue supply device of the invention.

Figure 27:
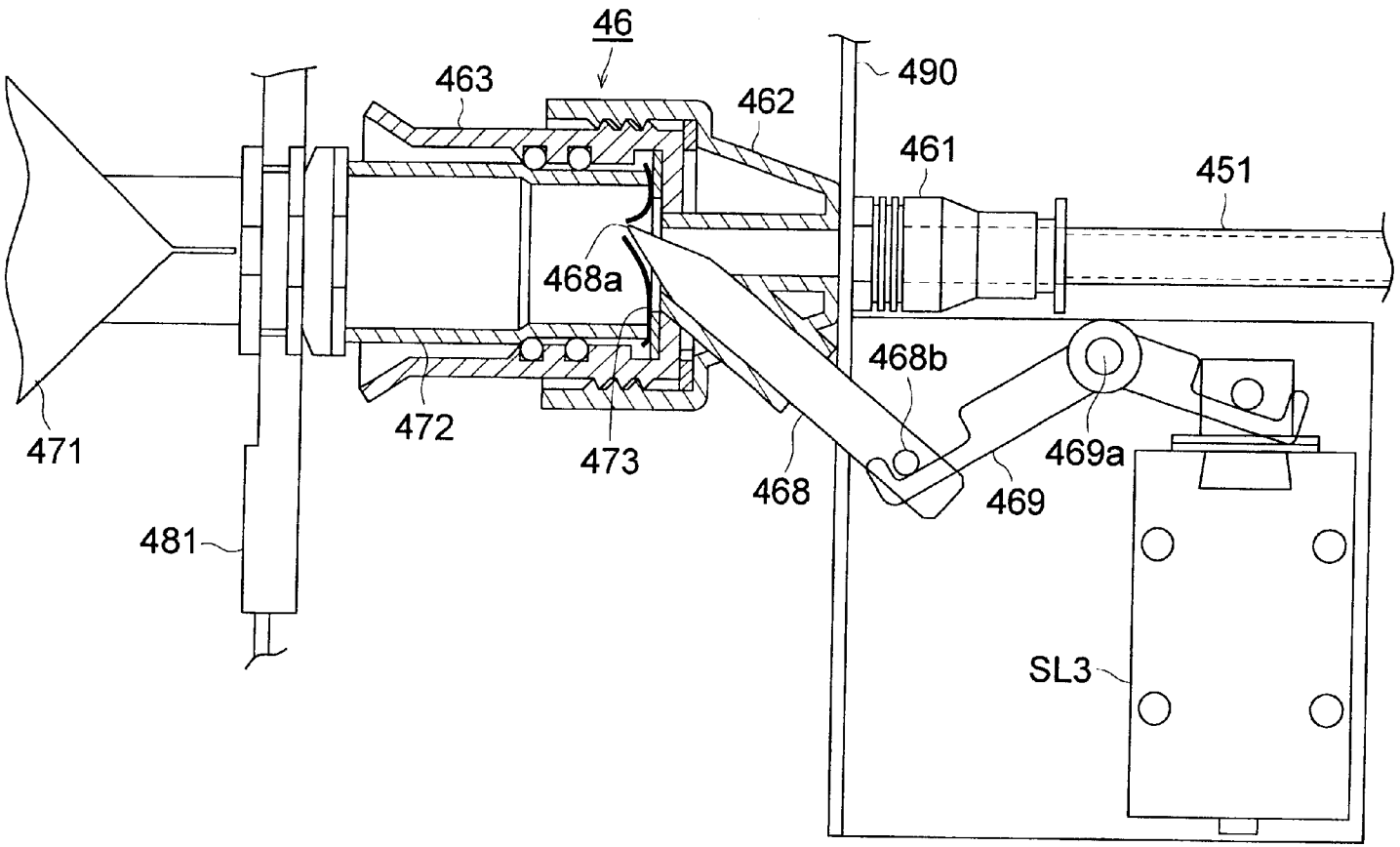

FIG. 27 is a sectional view showing a process of glue supply in the second embodiment of a glue supply device of the invention.

FIGS. 28(*a*)–28(*c*) show sectional views showing a process of glue supply in the eighth embodiment of a glue supply device of the invention.

DETAILED DESCRIPTION OF THE PREFERRED EMBODIMENT (First Embodiment)

A gluing device, a bookbinding apparatus with a gluing device and an image forming apparatus with a bookbinding apparatus will be explained as follows, referring to drawings.

Figure 1:
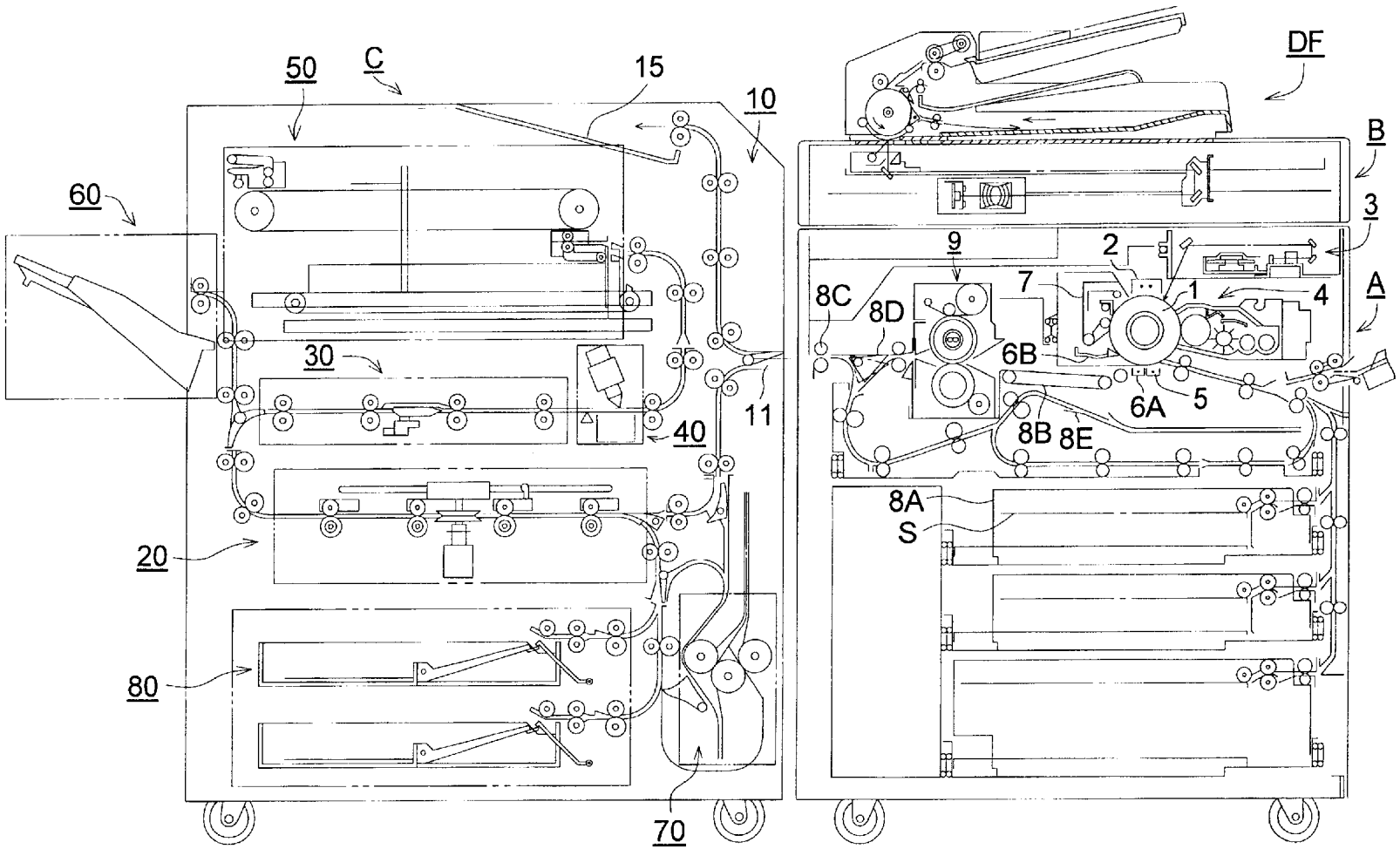
FIG. 1 is a general structural view of an image forming system composed of an image forming apparatus, an image reading apparatus and a bookbinding apparatus with a gluing device.

FIG. 1 is a general structural view of an image forming system composed of image forming apparatus main body A, image reading apparatus B and bookbinding apparatus with a gluing device C.

In the image forming apparatus main body A, charging means 2, image-wise exposure means (writing means) 3, developing means 4, transfer means 5, neutralizing means 6A, separation claw 6B and cleaning means 7 are arranged around rotary image carrier (hereinafter referred to as a photoreceptor) 1, and after the surface of photoreceptor 1 is charged uniformly by charging means 2, scanning for exposure is conducted by a laser beam of image-wise exposure means 3, and thereby, there is formed a latent image which is subjected to reversal development by developing means 4, thus, a toner image is formed on the surface of photoreceptor 1.

On the other hand, sheet S fed from sheet housing means 8A is conveyed to a transfer position. In the transfer position, the toner image stated above is transferred by transfer means 5 onto sheet S. After that, electric charges on the reverse surface of the sheet S are neutralized by neutralizing means 6A, then, the sheet S is separated from photoreceptor 1 by separation claw 6B, then is conveyed by intermediate conveyance section 8B to be heated and fixed by fixing means 9, and is ejected by sheet ejection roller 8C.

When conducting image forming on both sides of sheet S, sheet S which has been subjected to heating and fixing by fixing means 9 is diverged by conveyance path switching plate 8D from the ordinary sheet ejection path and is switched back at reversal conveyance 8E to be reversed, and then, is ejected out of an apparatus by sheet ejection roller 8C. The sheet S ejected from the sheet ejection roller 8C is fed into receiving portion 11 of bookbinding apparatus with a gluing device.

On the other hand, with regard to the surface of photoreceptor 1 which has been subjected to image processing, developing agents remaining on that surface are removed by cleaning means 7 at the position that is on the downstream side of separation claw 6B, to be ready for the succeeding image forming.

On the top of the image forming apparatus main body A, there is supported automatic document feeder DF of a document moving type reading system to be capable of being opened and closed.

In the bookbinding apparatus with a gluing device C, truing-up and pressuring means 50 is arranged on the top stage in the illustration, glue coating means 40 and sheet skew and deviation correcting means (hereinafter referred to as a sheet correcting means) 30 are arranged on the intermediate stage, sheet direction changing means 20 is arranged on the lower stage, and cover sheet feeding means 80 is arranged on the lowermost stage, all of the foregoing being arranged, longitudinally and vertically.

On the right side of the bookbinding apparatus with a gluing device C in the illustration, there are arranged entrance portion conveyance means 10 and folding means 70. On the left side of the bookbinding apparatus with a gluing device C in the illustration, there is arranged sheet ejection means 60 on which books subjected to gluing processing are stacked.

Figure 2:
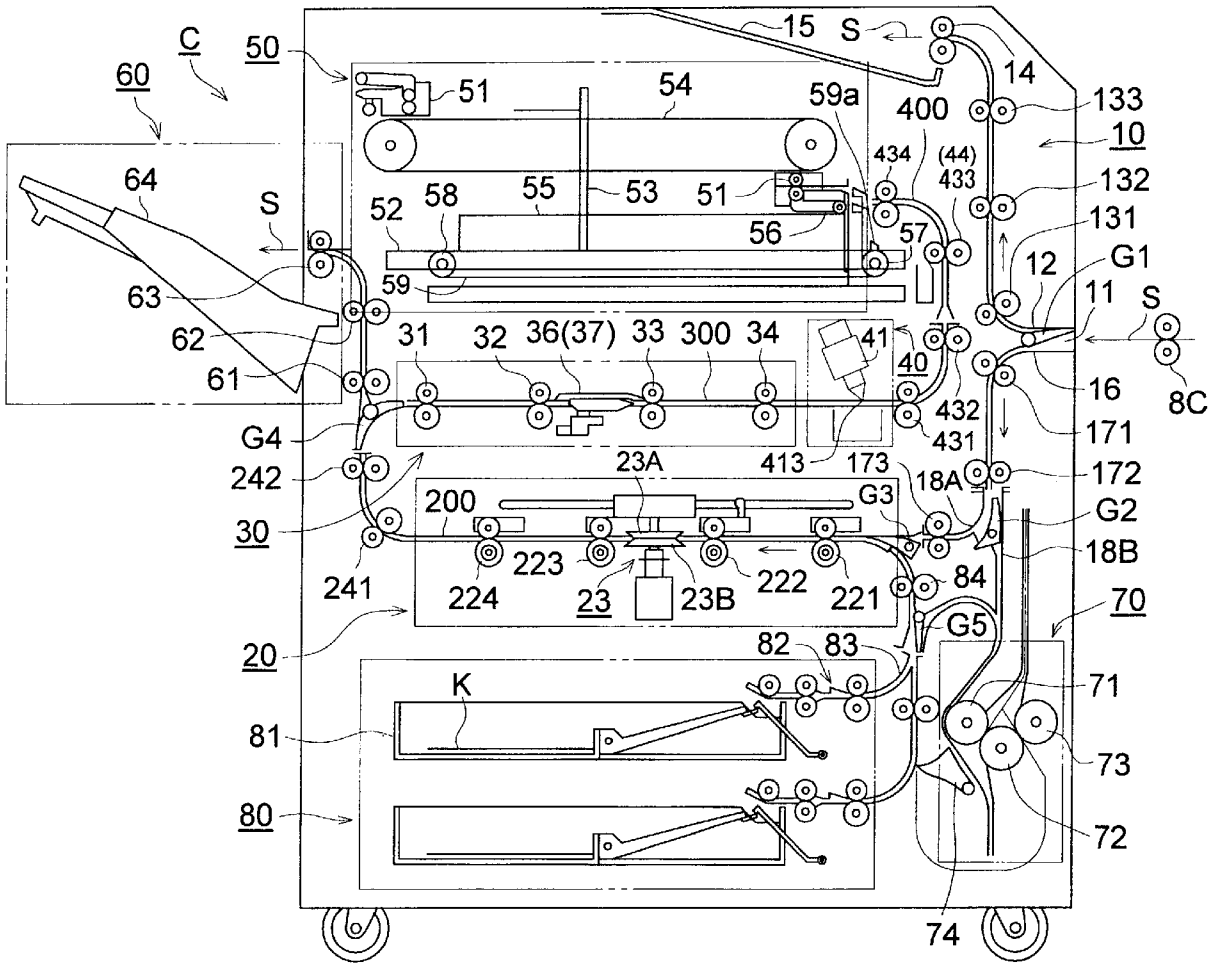
FIG. 2 is a structural diagram showing sheet conveyance paths in a bookbinding apparatus with a gluing device.
Figure 3:
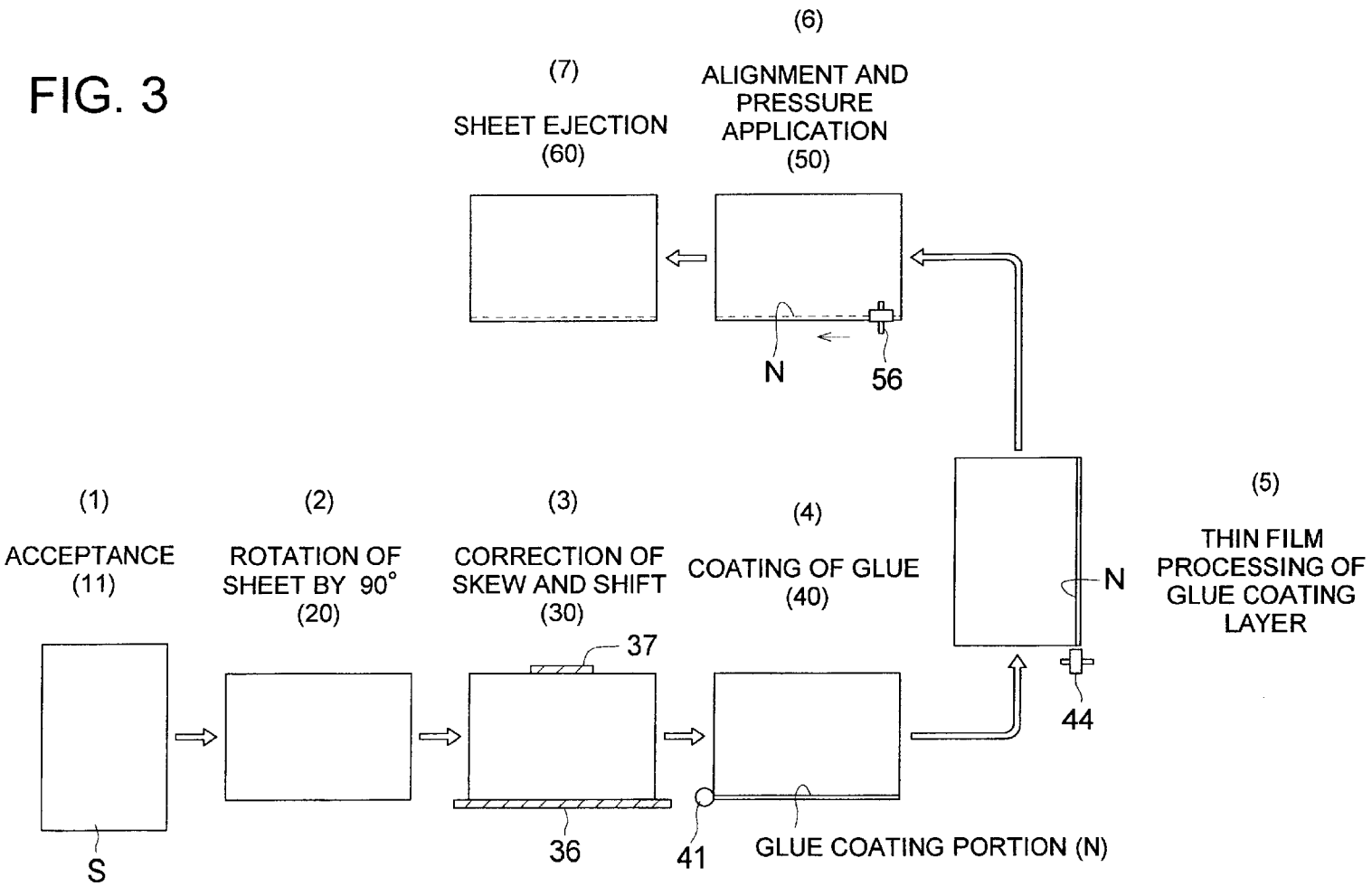
FIG. 3 is an illustrative diagram showing a process of gluing on a sheet and of bookbinding.

FIG. 2 is a structural diagram showing a sheet conveyance path in the bookbinding apparatus with a gluing device C. FIG. 3 is an illustrative diagram showing a process of gluing on a sheet and of bookbinding.

The bookbinding apparatus with a gluing device C is installed after being adjusted to the position and height where receiving portion 11 of entrance portion conveyance means 10 and sheet ejection roller 8C of the image forming apparatus main body A agree in terms of position and height each other.

A conveyance path for sheet S connected to receiving portion 11 is branched to upper sheet conveyance path 12 leading to fixed sheet ejection tray 15 on the uppermost step and to lower sheet conveyance path 16, and sheet S is fed to either one of them depending on selection of an angle occupied by switching gate G1.

The upper sheet conveyance path 12 is composed of conveyance rollers 131–133, ejection roller 14 and a guide plate. The lower sheet conveyance path 16 is composed of conveyance rollers 171, 172 and 173, switching gate G2 and a guide plate.

A sheet conveyance path connected to the lower sheet conveyance path 16 is branched to two systems leading respectively to sheet direction changing means 20 arranged on the intermediate stage and to folding means 70 arranged on the lowermost stage, and sheet S is fed to either one of them depending on selection of an angle occupied by switching gate G2.

(1) Direct sheet ejection to fixed sheet ejection tray 15 on the upper portion of an apparatus Sheet S subjected to image forming which is ejected from the image forming apparatus main body A is guided to receiving portion 11, then, passes through sheet conveyance path 12, then, is conveyed by conveyance rollers 131, 132 and 133, then, interposed by ejection rollers 14, and is ejected on fixed sheet ejection tray 15 that is located on the upper portion outside the apparatus to be stacked thereon successively.

In the course of conveyance of the sheet, switching gate G1 closes sheet conveyance path 16 and makes sheet conveyance path 12 to be opened, so that passage of the sheet S to fixed sheet ejection tray 15 may be made possible.

(2) Processing of changing direction of a sheet by 90°

When establishment is made to the sheet direction changing mode, switching gate G2 closes sheet conveyance path 18B and keeps sheet conveyance path 18A to be opened so that passage of the sheet S through the sheet conveyance path 18A may be made possible.

Sheet S subjected to image forming which is ejected from the image forming apparatus main body A passes through receiving portion 11, sheet conveyance path 16 and conveyance rollers 171 and 172, and then, passes through sheet conveyance path 18A formed by switching gate G2 to be in an opened state, then, is changed in terms of its direction to the almost perpendicular direction on the left side in the drawing and is interposed by ejection rollers 173 to be fed into sheet direction changing means 20.

The sheet S guided to the sheet direction changing means 20 passes through sheet conveyance path 200 opened to the upper portion of switching gate G3 and is interposed by conveyance rollers 221, 222, 223 and 224 to be advanced in the arrowed left direction illustrated.

When a central portion of the sheet S arrives at rotating member 23, sheet conveyance is suspended momentarily, and pressure contact for the conveyance rollers 221, 222, 223 and 224 is released and each of them is kept to be away. When upper rotary disk 23A and lower rotary disk 23B of the rotating member 23 interpose the sheet S and rotate under the condition that the conveyance rollers 221–224 are released from the pressure contact, the direction of the sheet S is changed by 90°. For example, sheet S in A4 size is changed by rotating member 23 to the direction of A4R.

The sheet direction changing means 20 can rotate sheet S by 90° and move the sheet S to one side simultaneously. Or, the sheet direction changing means 20 can rotate sheet S by 90° or move the sheet S to one side independently.

The sheet S whose rotation direction has been changed is conveyed by pressure contact rotation of conveyance rollers 221–224, and is conveyed out of the sheet direction changing means 20 to be conveyed by conveyance rollers 241 and 242, and its direction is changed upward by almost 90° in the illustration, then, the sheet S passes through switching gate G4 to be further changed to the right side in the drawing, and it is fed into sheet correction means 30.

Sheet S that requires no bookbinding processing with gluing passes through a sheet conveyance path on the left side of switching gate G4, and is conveyed by conveyance rollers 61 and 62 to be ejected by ejection roller 63 to elevating sheet ejection tray 64 that is located outside the apparatus.

(3) Sheet skew/deviation correcting means

Sheet correction means 30 that corrects skew and deviation of sheet S is composed of conveyance rollers 31, 32, 33 and 34 which can interpose sheet S and can release it, sheet conveyance path 300, truing-up reference plate 36 and truing-up/correcting plate 37, and thus, sheet S which has not been subjected to glue coating processing is brought into contact with the truing-up reference plate 36 to be trued up on its one side.

(4) Glue coating processing for sheet S

Sheet S fed into gluing means 40 from the sheet correction means 30 is moved toward the right side in the drawing. Both of sheet conveyance path 400 in a glue coating section of glue coating means 40 and sheet conveyance path 300 of sheet correction means 30 are formed to be almost in parallel with sheet conveyance path 200 of sheet direction changing means 20, and a conveyance direction for sheet S is opposite to that for the sheet direction changing means 20.

Glue discharging means 41 houses therein glue supplied from glue supply means 48 (see FIG. 5), and discharges the glue on an edge portion on one side of running sheet S in a strap shape or in an intermitted broken line shape to form glue-coated portion N.

The sheet S which has been subjected to glue coating processing is conveyed upward while being interposed by conveyance rollers 431, 432 and 433, then, is conveyed along sheet conveyance path 400 formed by a guide plate, and is interposed by ejection roller 434 to be ejected to truing-up and pressuring means 50.

(5) Thinning processing for glue-coated layer

In the vicinity of the downstream side of the glue coating means 40, there is arranged membrane forming roller 44 fixed on the end of a rotary shaft of conveyance roller 433.

Glue discharged from nozzle member 413 located on the tip portion of glue discharging means 41 form small semi-cylindrical glue-coated portion N on the surface of sheet S. When the sheet S is conveyed, glue-coated portion N formed on the sheet S is rolled by the membrane forming roller 44 located at the downstream side to become glue-coated portion N having a prescribed glue-coated thickness, thus, a flat and strap-shaped membrane glue-coated layer is formed.

(6) Truing-up and pressuring processing

First sheet S to be subjected to no glue coating processing is interposed by gripping means (gripper means) 51 and is placed at a prescribed position on sheet housing means (hereinafter referred to as a stacker) 52 with its leading edge portion coming in contact with stopper 53. The gripping means 51 is moved while being supported by rotating belt 54.

Second sheet S which has been subjected to glue coating processing is interposed by the gripping means 51 in the same way as in the foregoing, and is placed successively, with its glue coated portion N facing downward, on the preceding sheet S on the stacker 52. The numeral 55 represents a pair of width-regulating member which can move in its lateral direction, and it regulates the lateral direction of sheet S.

Pressuring roller member 56 moves together with the gripping means 51 while being supported by rotating belt 54. Pressuring roller member 56 moves while being in pressure contact with a gluing reverse side of sheet S, to ensure adhesion between sheets.

Pressuring processing for sheet S conducted by the pressuring roller member 56 may also be carried out every time each of the second sheet S and thereafter is placed on the stacker 52. Or, the pressuring processing may also be carried out each time a plurality of sheets S are stacked.

Bookbinding for one copy which has been subjected to gluing processing is completed by the above-mentioned process. Incidentally, in this bookbinding apparatus with a gluing device C, sheets S in quantity of the maximum number of 200 can be processed in terms of gluing to be bound.

(7) Stacking of a bundle of sheets and sheet ejection

On a part of a sheet stacking surface of stacker 52, there are movably arranged a plurality of ejection belts 59 trained about driving roller 57 and driven roller 58.

A bundle of sheets subjected to pressuring processing and bookbinding with gluing with its last sheet S being placed on the stacker 52 glides on a placement surface of the stacker 52 with the rear end portion of the bundle of sheets being held by ejection claw 59*a* of ejection belt 59 and it is interposed by ejection roller 63 of sheet ejection means 60 and is ejected on elevating sheet ejection tray 64 to be stacked thereon.

On the elevating sheet ejection tray 64, both sheet S subjected to glue coating processing and sheet S subjected to no glue coating processing can be stacked, and elevating drive makes it possible for the elevating sheet ejection tray 64 to house a large quantity of sheets S.

(8) Cover sheet feeding

Cover sheet feeding means 80 is composed of sheet feed cassette 81 and sheet feed member 82. A piece of cover sheet K fed from sheet feed cassette 81 passes through sheet feeding path 83 and conveyance roller 84, to be fed into sheet direction changing means 20, and it passes through sheet correction means 30 to be superposed on the top face or the bottom face of the bundle of sheets stated above for bookbinding with gluing.

A piece of cover sheet K fed from sheet feed cassette 81 passes through sheet feeding path 83, and it is diverged by switching gate G5 to be fed into folding means 70 stated later where it is folded double, and then, passes through conveyance roller 84 to be fed into sheet direction changing means 20 and is superposed on the bundle of sheets for bookbinding with gluing, after passing through sheet correction means 30, glue coating means 40 and truing-up and pressuring means 50.

(9) Folding processing

Sheet S conveyed from sheet conveyance path 16 to the lower portion in the drawing is diverged in switching gate G2, and is conveyed into folding means 70 through sheet conveyance path 18B. The folding means 70 is composed of folding rollers 71, 72 and 73 and of conveyance path switching plate 74, and it conducts double folding or Z-folding for sheet S which has been fed in. The folded sheet S is merged by switching gate G5 into a sheet feed path for a cover sheet, and is fed into sheet direction changing means 20 through conveyance roller 84 and switching gate G2, and it further passes through sheet correction means 30, glue coating means 40 and truing-up and pressuring means 50 to be subjected to bookbinding with gluing.

Each of FIGS. 4(*a*)–4(*d*) is a perspective view showing a glue coating position on each type of sheet S. FIG. 4(*a*) is a diagram wherein glue coated portion N is formed in the longitudinal direction on the longer side of sheet S, FIG. 4(*b*) is a diagram wherein glue coated portion N is formed in the lateral direction on the shorter side of sheet S, FIG. 4(*c*) is a diagram wherein glue coated portion N is formed on double-folded sheet S, and FIG. 4(*d*) is a diagram wherein glue coated portion N is formed on Z-folded sheet S.

FIG. 5(*a*) is a top view in the vicinity of glue discharging means 41 of sheet correction means 30 and glue coating means 40, while, FIG. 5(*b*) is a front view in the vicinity of glue discharging means 41 of glue coating means 40.

The sheet correction means 30 is arranged between conveyance roller 32 and conveyance roller 33. The sheet correction means 30 is composed of truing-up reference plate 36 and truing-up/correcting plate 37 which face each other in the direction of a width of sheet S that is perpendicular to the sheet conveyance direction.

The truing-up reference plate 36 is arranged to be fixed on the apparatus main body to be in parallel with the sheet conveyance direction. Sheet S comes in contact with a side edge portion of the truing-up reference plate 36 in the direction of a width of the sheet S, and thereby, the sheet S is positioned. The truing-up/correcting plate 37 can move in the direction perpendicular to the sheet conveyance direction depending on the size of sheet S in its width direction, and it is moved by an unillustrated driving means from the prescribed retreated position in the direction perpendicular to the sheet conveyance direction, to press the side edge portion of sheet S. The truing-up/correcting plate 37 presses the vicinity of the center of the truing-up reference plate 36 through sheet S existing between them so as to prevent inclined contact of sheet S on the truing-up reference plate 36 and to make a side edge portion of sheet S to be in close contact with the truing-up reference plate 36.

Between conveyance roller 34 and conveyance roller 431, there is arranged glue discharging means 41 which applies glue on a side edge portion of sheet S. The glue discharging means 41 is driven by first driving means 42A and second driving means 42B to discharge glue on demand. Below the glue discharging means 41, there is arranged collecting container 40A. The numeral 48 represents a glue supply means that supplies glue to the glue discharging means 41.

FIG. 6 is an enlarged sectional view of glue discharging means 41 and a driving means.

The glue discharging means 41 is composed of casing 410, first needle member 411, second needle member 412 and nozzle member 413. The first driving means 42A moves the first needle member 411. The second driving means 42B moves the second needle member 412.

The nozzle member 413 has therein glue housing chamber 413*b* that houses glue and nozzle opening portion 413*a*. On the side of the nozzle member 413, there is opened introduction opening 413*c*. Glue for sheet adhesion housed in glue housing container 47 which will be described later is force-fed by glue supply means 48 to be supplied from the introduction opening 413*c* into glue housing chamber 413*b* of the nozzle member 413 through supply tube 451 of conveyance means 45.

The first needle member 411 moves through the nozzle opening portion 413*a* of the nozzle member 413 so that the nozzle opening portion 413*a* may be opened and closed. The second needle member 412 moves so that a glue supply path through which the glue in the glue housing chamber 413*b* of the nozzle member 413 flow may be opened and closed. Tip portion 411*a* of the first needle member 411 can move through tip opening portion 412*a* of the second needle member 412.

When voltage is impressed on first solenoid SL1, plunger SL1*a* is attracted, pin SL1*b* presses down an end portion on the other side of first lever 421, the first lever 421 is rotated counterclockwise about supporting shaft 425, and an end portion on one side of the first lever 421 pushes up pin 416A so that the first needle member 411 is pulled up in the axial direction.

Next, when voltage is impressed on second solenoid SL2, plunger SL2*a* is attracted, pin SL2*b* presses down an end portion on the other side of second lever 422, the second lever 422 is rotated clockwise about supporting shaft 426, and an end portion on one side of the second lever 422 pushes up pin 416B so that the second needle member 412 is pulled up in the axial direction.

The second needle member 412 is force-fitted to be fixed in the lower end portion of tubular object 414 in a shape of a hollow cylinder. The tubular object 414 is fitted with bearing 415A fixed on casing 10 and with bearing 415B fixed on covering object 410A, and it is supported to be movable up and down. The tubular object 414 is urged downward by spring 418B. On the upper portion of the tubular object 414, there is fixed pin 416B which is connected with the second driving means 42B.

Inside the tubular object 414, there is housed the first needle member 411 in a movable manner. Tip portion 411*a* on the lower portion of the first needle member 411 is fitted with tip opening portion 412*a* of the second needle member 412. Sliding member 417A fixed on the intermediate portion of the first needle member 411 slides on an inner wall of the tubular object 414.

Sliding member 417B fixed on the upper portion of the first needle member 411 slides on the upper portion of an inner wall of the tubular object 414. The sliding member 417B is fitted with bearing 415C force-fitted in supporting member 410B which is fixed on the upper portion of casing 410, and it is supported to be movable up and down.

Inside the casing 410, there is force-fitted packing member 419. The inner circumferential surface of the packing member 419 slides on an outer circumferential surface of the tubular object 414, and seals an upper portion of the glue housing chamber 413*b*.

On the sliding member 417B, there is fixed pin 416A which is connected with the first driving means 42A. The sliding member 417B is urged downward by spring 418A.

On the flank on one side of the casing 410, there is arranged first driving means 42A which drives the first needle member 411. On supporting shaft 425 fixed on supporting member 423 that is connected to the side of the casing 410, there is supported first lever 421 to be capable of swinging. An end portion on one side of the first lever 421 holds pin 416A that is connected to the first needle member 411. An end portion on the other side of the first lever 421 comes in contact with pin SL1*b* fixed on plunger SL1*a* of the first solenoid SL1.

On the flank on the other side of the casing 410, there is arranged second driving means 42B which drives the second needle member 412. On supporting shaft 426 fixed on supporting member 424 that is connected to the side of the casing 410, there is supported second lever 422 to be capable of swinging. An end portion on one side of the second lever 422 holds pin 416B that is connected to the second needle member 412. An end portion on the other side of the second lever 422 comes in contact with pin SL2*b* that is fixed on plunger SL2*a* of the second solenoid SL2.

When voltage is impressed on first solenoid SL1, plunger SL1*a* is attracted, pin SL1*b* presses down an end portion on the other side of first lever 421, the first lever 421 is rotated counterclockwise about supporting shaft 425, and an end portion on one side of the first lever 421 pushes up pin 416A so that the first needle member 411 is pulled up in the axial direction.

Next, when voltage is impressed on second solenoid SL2, plunger SL2*a* is attracted, pin SL2*b* presses down an end portion on the other side of second lever 422, the second lever 422 is rotated clockwise about supporting shaft 426, and an end portion on one side of the second lever 422 pushes up pin 416B so that the second needle member 412 is pulled up in the axial direction.

Each of FIGS. 7(*a*), 7(*b*) and 7(*c*) is an enlarged sectional view showing the movement process of the first needle member 411 and the second needle member 412.

FIG. 7(*a*) shows a first position wherein a tip portion of the second needle member 412 shuts tightly an inside of nozzle opening portion 413*a* of nozzle member 413 to cut a glue supply path, and tip portion 411*a* of the first needle member 411 protrudes from a tip portion of nozzle opening portion 413*a* for discharging glue of nozzle member 413 to create the covered state.

In this first position, no voltage is impressed on the first solenoid SL1 and the second solenoid SL2, and the first needle member 411 is urged by spring 418A to be protruded from the tip portion of nozzle opening portion 413*a* to be suspended. The second needle member 412 is urged by spring 418B, and a tapered portion of the tip base portion of the second needle member 412 and an inclined portion inside the nozzle opening portion 413*a* of nozzle member 413 come into contact with each other, thus, the glue housing chamber 413*b* is held to be in the covered state, and discharging of glue is prevented.

FIG. 7(*b*) shows the state of standby wherein voltage is impressed only on the first solenoid SL1 to drive it, and the first lever 421 is swung to be suspended temporarily at the second position. In this second position, tip portion 411*a* of the first needle member 411 moves to the inside of the first position, and leaves the nozzle opening portion 413*a* of the nozzle member 413 to make the nozzle opening portion to be in the opened state, and it further retreats in the tip opening portion 412*a* of the second needle member 412 to be held in the state of standby before blue discharging.

The first driving means composed of the first solenoid SL1 and the first lever 421 drives the first needle member 411 before glue coating operations to make the first needle member to reciprocate between the first position and the second position so that glue solidified on nozzle opening portion 413*a* of nozzle member 413 and on tip opening portion 412*a* of the second needle member 412 may be removed (purging).

The number of reciprocations and a length of the stroke of the reciprocation of the first needle member 411 for prevention of glue solidification are established to be the optimum conditions based on data of the nozzle opening portion 413*a* and of the first needle member 411 and on characteristics of glue.

Glue used in an embodiment of the invention represent adhesive agents of a vinyl acetate type, and viscosity thereof is 750–1500 mPa·s at the normal temperature.

Incidentally, reciprocations of the first needle member 411 for preventing glue solidification on the nozzle opening portion 413*a* is conducted before the start of gluing on sheet S, and solidified glue and glue discharged simultaneously are collected in the lower collecting container 40A.

FIG. 7(*c*) shows the state of coating wherein the first solenoid SL1 is held to be impressed with voltage, and further, voltage is impressed on the second solenoid SL2, and the second lever 422 is swung to be stopped at the third position. In this third position, a tip portion of the second needle member 412 is moved to the inside of the second position to be held on the same plane as that for tip portion 411*a* of the first needle member 411. When the second needle member 412 is moved, the nozzle opening portion 413*a* is held to its full-open state, a glue supply path is communicated, and glue in glue housing chamber 41 becomes possible to be discharged.

FIG. 8(*a*) is a perspective view of glue container 47 and FIG. 8(*b*) is a sectional view thereof.

The glue container 47 is composed of flexible bag object 471 that houses glue Na (crosshatched portion in illustration) and of capsule member 472.

The capsule member 472 is composed of ejection opening 472*a* capable of ejecting glue Na housed in flexible bag object 471 container and of mounting portion 472*b* capable of mounting on glue supply means 48.

The flexible bag object 471 has two flat portions 471*a* and 471*b* which face each other. These flat portions 471*a* and 471*b* are pressed by a flat pressing member described later, and thereby glue Na housed in the flexible bag object 471 is ejected from the ejection opening 472*a*.

A material for the flexible film object forming the flat portions 471*a* and 471*b* is formed by a laminated material made of polyethylene terephthalate (PET), aluminum foil and polyethylene (PE).

FIG. 9(*a*) is a top view of glue supply means 48 showing the initial state where the glue container 47 is mounted on the glue supply means 48, and FIG. 9(*b*) is a sectional front view thereof.

The glue supply means 48 of the invention is composed of pressuring means (pneumatic apparatus such as a gas spring, hereinafter referred to as pneumatic apparatus) GS that presses the glue container 47 to supply housed glue Na to glue discharging means 41 and of a releasing means that releases the pressing to make the glue container 47 to be mounted or dismounted.

Two flat portions 471*a* and 471*b* of the flexible bag object 471 facing each other are pressed by pressing means 482A and 482B. The pressing means 482A is supported rotatably on shaft 484A fixed on arm 483A. The arm 483A is fixed on swinging shaft 485A that is supported rotatably on casing 480 of the glue supply means 48.

The arm 483A fixed on the swinging shaft 485A is swung by driving pressure of a pneumatic apparatus described later in the direction shown with a one-dot chain line. When the arm 483A is swung, pressing member 482A connected by shaft 484A moves in the direction shown with a void arrow, and presses the flat portion 471*a* of the flexible bag object 471.

Simultaneously with the foregoing, the arm 483B fixed on the swinging shaft 485B is swung by driving pressure of the pneumatic apparatus GS in the direction shown with a one-dot chain line. When the arm 483B is swung, pressing member 482B connected by shaft 484B moves in the direction shown with a void arrow, and presses the flat portion 471*b* of the flexible bag object 471.

FIG. 10 is a top view of glue supply means 48 wherein glue container 47 mounted on glue supply means 48 is flat.

When driving pressure of the pneumatic apparatus GS makes the pressing members 482A and 482B to press glue container 47 to create the illustrated state, protruded portion 489 (see FIG. 9(*b*)) fixed on the end of the swinging shaft 485B intercepts a detection optical path of sensor PS1 to detect the final detection position, and an alarm for running short of glue in the glue container 47 is given to indicate replacement of the glue container 47.

Prior to mounting of the blue container 47 on the glue supply means 48, a driving source (motor M1 shown in FIGS. 9 (*a*) and 9(*b*)) is started, then, arms 483A and 483B are swung conversely through a drive transmission mechanism (pressing releasing mechanism) described later, and pressing members 482A and 482B are moved from the closed position shown in FIG. 10 to the open position shown in FIGS. 9(*a*) and 9(*b*). In the course of opening the pressing members 482A and 482B, pneumatic apparatus GS is compressed against extending force of plunger GSp.

Under the condition that the pressing members are in the position where they are opened shown in FIGS. 9(*a*) and 9(*b*), glue container 47 can be mounted on the glue supply means 48 from the upper portion of container mounting portion 481 or dismounted from the glue supply means 48 both in the direction perpendicular to the direction for the pressing members 482A and 482B to move.

When mounting glue container 47 on glue supply means 48, supply tube 451 connected to introduction opening 413*c* of glue discharging means 41 is connected to ejection opening 474 of capsule member 472 of the glue container 47 through connecting member 46 on the supply tube side, then, switching valve 452 is opened and glue Na in flexible bag object 471 is communicated with glue discharging means 41.

When starting glue supply, driving force of a driving source is kept to be in the state of suspension thereof, and the transmission mechanism is left to be in the state of free rotation by a one-way mechanism and a play mechanism through extending force caused by pressing load P of the pneumatic apparatus GS.

Under the state of free rotation, pressing members 482A and 482B are moved in the direction of an arrow by pressing load P of the pneumatic apparatus GS. When pressing members 482A and 482B are moved, flat portions 471*a* and 471*b* of flexible bag object 471 are pressed from both sides, and glue Na in the flexible bag object 471 is compressed and ejected from ejection opening 572*a* to be supplied to glue discharging means 41.

When glue coating processing by glue discharging means 41 is not conducted, or when glue container 47 is mounted or dismounted, the pressing members 482A and 482B can be separated manually by operations of a releasing means to release pressing by driving the driving means conversely.

FIG. 11 is a top view of a pressing driving mechanism of glue supply means 48.

Sector gear Z13 is connected with joint GSj positioned at the tip of reciprocating plunger GSp of pneumatic apparatus GS. Main body section GSa of the pneumatic apparatus GS is fixed on casing 480. The pneumatic apparatus GS is composed of a gas spring and urges in the direction of an arrow by protruding plunger GSp with uniform pressing load P.

The plunger GSp of the pneumatic apparatus GS is protruded from main body section GSa by pressing load P to rotate the sector gear Z13 clockwise and thereby to rotate swinging shaft 485A solidly. Further, arm 483A fixed on the swinging shaft 485A is also swung to rotate shaft 484A in the direction of an arrow of illustrated one-dot chain lines. Pressing member 482A supported on the shaft 484A moves flexible bag object 471 of glue container 47 in the direction to compress it.

The sector gear Z13 is engaged with sector gear Z12. When the sector gear Z13 rotates clockwise, sector gear Z12 is rotated counterclockwise to rotate solidly swinging shaft 485B on which the sector gear Z12 is fixed. Further, arm 483B fixed on the swinging shaft 485B is also rotated, then, shaft 484B is rotated in the direction of an arrow of illustrated one-dot chain lines, and pressing member 482B supported on the shaft 484B is moved in the direction to compress the flexible bag object 471 of glue container 47.

In the course of compressing glue container 47 with pneumatic apparatus GS, driving of motor M1 for releasing compression is suspended, and a driving system for transmitting power to sector gears Z12 and Z13 is also kept to be in the state of suspension.

Inside the sector gear Z12, there is formed fan-shaped cavity 4851, and inside the sector gear Z13, there is formed fan-shaped cavity 4852. Further, on swinging shaft 485A, there is embedded pin 4853, and on swinging shaft 485A, there is embedded pin 4853, and on swinging shaft 485B, there is embedded pin 4854. When arm 483A and 483B are rotated by pressing load P of pneumatic apparatus GS in the direction to compress glue container 47, each of pins 4853 and 4854 comes in contact with a side wall on one side of each of fan-shaped cavities 4851 and 4852 to rotate each of gears Z12 and Z13, and thereby, arms 483A and 483B are swung and flexible bag object 471 is pressed by pressing members 482A and 482B.

FIG. 12 is a top view of a pressing releasing mechanism of glue supply means 48.

When motor M1 for releasing compression drives, worm gear Z1 fixed on a rotary shaft of the motor M1 rotates worm wheel Z2 to further rotate gear Z3 through timing belt TB. The gear Z3 rotates swinging shaft 485B through gears Z4, Z5, Z6, Z7, Z8, Z9, Z10 and Z11.

Swinging shaft 485B rotates shaft 484B embedded in arm 483B that is fixed on the swinging shaft 485B in the direction of an arrow of illustrated one-dot chain lines, and moves pressing member 482B supported on the shaft 484B in the direction of its opening.

Sector gear Z12 fixed on the lower shaft end portion of the swinging shaft 485B is engaged with sector gear Z13 fixed on the lower shaft end portion of the swinging shaft 485A.

When the sector gear Z12 is swung by motor M1 and a gear train of a drive transmission mechanism to rotate in the illustrated clockwise direction, the sector gear Z13 rotates in the illustrated counterclockwise direction. Swinging shaft 485A on which the motor gear Z13 is fixed also rotates integrally, and it swings arm 483A, rotates shaft 484A in the direction of an arrow of illustrated one-dot chain lines, and moves pressing member 482A supported on shaft 484A in its opening direction.

In the course of operations for releasing compression, pin 4854 embedded in swinging shaft 485A comes in contact with the other side wall of cavity 4852 provided inside sector gear Z13, and rotates sector gear Z12 counterclockwise.

When motor M1 stops driving, each of fan-shaped cavities 4851 and 4852 becomes capable of moving freely within an angle of play between both side walls against each of pins suspended, and thus, each of arms 483A and 483B becomes capable of moving freely within this angle of play. Since pressing members 482A and 482B are made to be free for moving by free moving of the arms 483A and 483B, it becomes possible to move pressing members 482A and 482B easily by holding them, and thereby to make them to part from each other. When pressing members 482A and 482B are made to part from each other, glue container 47 can be mounted and dismounted.

Each of FIGS. 13(*a*) and 13(*b*) is a sectional top view showing the state wherein a connecting means on the supply tube side has been removed from a connecting means on the glue container side, and FIG. 13(*c*) is a sectional top view showing the state wherein the connecting means on the supply tube side is connected to the connecting means on the glue container side. FIG. 14(*a*) is an enlarged sectional view of the connecting means on the glue container side when glue supply is suspended, and FIG. 14(*b*) is an enlarged sectional view of the connecting means on the glue container side and the connecting means on the supply tube side both in the case of glue supply.

A connecting means on the glue container side is composed of male screw section 472*c* provided on capsule member 472 of glue container 47 and of female screw section 473*a* provided on cap portion 473. On the tip portion of the cap portion 473, there is provided ejection opening section 473*b*.

In the hollow section inside the ejection opening section 473*b*, there is inserted spherical valve member 474 having a diameter that is greater than an inside diameter of the ejection opening section 473*b*. The valve member 474 is urged by elastic member 475 such as a coil spring to close the ejection opening section 473*b* from its inside. The elastic member 475 is held by washer 476 and rubber seal member 477 which are interposed between a tip portion of the capsule member 472 and the cap portion 473.

An end portion on one side of supply tube 451 through which glue flows and is supplied to glue discharging means 41 is connected to outer cylinder member 461 of connecting means 46 on the supply tube side. Female screw section 461*a* provided on the outer cylinder member 461 engages with male screw section 462*a* provided on inner cylinder member 462.

In a groove section provided on an inside diameter section of the inner cylinder member 462, there is fitted O-ring 463. On an outer end face of the inner cylinder member 462, there is supported rotatably check valve 464 which is urged by spring 465 to close opening section 462*b* of the inner cylinder member 462. On an inner end face of the inner cylinder member 462, there is protruded protrusion 466.

Between an outer end face of the inner cylinder member 462 and an inner end face of the outer cylinder member 461, there is interposed rubber seal member 467 which prevents leakage of glue. On an inner end face of the inner cylinder member 462, there is stuck rubber seal member 468.

When connecting means 46 on the supply tube side is connected to the connecting means on the glue container side, an inside diameter section of the inner cylinder member 462 slides on and connected with an outer circumferential surface of the cap portion 473 through O-ring 463 to prevent leakage of glue. During the period of this connection, the rubber seal member 468 stuck on an inner end face of the inner cylinder member 462 comes in pressure contact with an outer end face of the cap portion 473 to prevent leakage of glue.

In virtue of this connection, the protrusion 466 of the connecting means 46 on the supply tube side presses an outer circumferential surface of the valve member 474 of the connecting means on the glue container side against urging of the spring to press and move the valve member toward the glue container side. With the movement of the valve member 474, ejection opening section 473*b* of the cap portion 473 is opened. Glue contained in glue container 47 are pressurized by pressing members 482A and 482B to be ejected from ejection opening 472*a*, and then, the glue makes check valve 464 to swing against urging of the spring, and pass through the opened ejection opening 473*b* to flow in supply tube 451.

FIG. 15(*a*) is a top view wherein driving means 49 which moves connecting means 46 on the supply tube side is not connected, and FIG. 15(*b*) is a front view wherein the driving means 49 is connected.

Gear Z21 fixed on a driving shaft of motor M2 rotates gear Z22 through an unillustrated speed reducing gear train. One end of wire W1 which is trained about pulley PL1 fixed on a rotary shaft of the gear Z22 is fixed on one end of moving object 490. Wire W2 fixed on the other end of the moving object 490 is trained about pulleys PL2 and PL3, and is stretched by coil spring 491.

On the moving object 490, there is fixed connecting means 46 on the supply tube side which is composed of outer cylinder member 461 and inner cylinder member 462. Sliding object 492 fixed on the base of the moving object 490 travels straight on the surface of slide rail 493 that is fixed on the apparatus main body. The slide rail 493 is equipped with a slide bearing and supports the moving object 490 so that it may travel straight.

The moving object 490 is pulled toward the glue container 47 by tension force of coil spring 491, and it makes connecting means 46 on the supply tube side to move so that the inner cylinder member 462 may be connected to the cap portion 473 of the connecting means on the glue container side. Under the state of this connection, glue in the glue container 47 is supplied to glue discharging means 41 through the connecting means and supply tube 451.

When the glue container 47 is mounted on or dismounted from glue supply means 48, or when the glue container 47 is replaced, motor M2 is driven to rotate pulley PL1 through a drive transmission means such as a gear train, then, moving object 490 is moved straight by rotation of wire W1 against tension force of coil spring 491, and connecting means 46 on the supply tube is made to leave the connecting means on the glue container side.

(Second Example)

Each of FIGS. 16(*a*) and 16(*b*) shows another embodiment of a glue supply means of the invention, and FIG. 16(*a*) is an enlarged sectional view of the connecting means on the glue container side under the condition of suspension of glue supply, while, FIG. 16(*b*) is an enlarged sectional view of the connecting means on the glue container side under the condition of glue supply and the connecting means on the supply tube side. Incidentally, with regard to symbols used in the drawings, parts having the same functions as those in FIGS. 14(*a*) and 14(*b*) are given the same symbols. Further, the points which are different from those in the first embodiment will be explained.

On an inner wall of cap portion 473 of the connecting means on the glue container side, there is formed inclined surface portion 473*c*. Spherical valve member 474 inserted in the cap portion 473 moves downward obliquely by gravity along the inclined surface portion 473*c* to close ejection opening 473*b*.

When the connecting means on the glue container side is connected to the connecting means on the supply tube side, protrusion 466 of inner cylinder member 462 presses valve member 474 to make it to move upward obliquely along the inclined surface portion 473*c*. With the movement of the valve member 474, ejection opening 473*b* of the cap portion 473 is opened, which makes glue which have passed through opening section 462*b* of inner cylinder member 462 to be sent to supply tube 451.

(Third Embodiment)

Each of FIGS. 17(*a*)–17(*c*) shows another embodiment of a glue supply means of the invention, and each of FIGS. 17(*a*) and 17(*b*) is a top sectional view showing the connecting means on the supply tube side and the connecting means on the glue container under the condition of non-connection, while, FIG. 17(*c*) is a front view showing the connecting means on the supply tube side and the connecting means on the glue container under the condition of connection. Incidentally, with regard to symbols used in the drawings, parts having the same functions as those in FIGS. 14(*a*)–15(*b*) are given the same symbols. Further, the points which are different from those in the first embodiment will be explained.

Inside the cap portion 473, there are housed dish-shaped valve member 478, rubber seal members 4771 and 4772 and elastic member 475 such as a coil spring. Under the condition of non-connection between connecting means 46 on the supply tube side and the connecting means on the glue container side, the valve member 478 is urged by the elastic member 475 and is brought into pressure contact with rubber seal member 4772 to close ejection opening 473*b*. Under the condition of connection between connecting means 46 on the supply tube side and the connecting means on the glue container side, protrusion 466 protruded to the inside of inner cylinder member 462 presses valve member 478 so that the valve member 478 may be moved toward capsule member 472 to open ejection opening 473*b*. Glue in glue container 47 passes through the opened ejection opening 473*b*, then passes through opening 462*b* under check valve 464 swung by ejection pressure of the glue, and is sent to supply tube 451 forcibly.

(Fourth Embodiment)

Each of FIG. 18 and FIG. 19 shows still another embodiment of a glue supply means of the invention, and FIG. 18 is a sectional top view of a connecting means on the glue container side, while, FIG. 19 is a sectional front view of connecting means 46 under the state of connection and the connecting means on the glue container side. Incidentally, with regard to symbols used in the drawings, parts having the same functions as those in FIGS. 14(*a*) and 14(*b*) are given the same symbols. Further, the points which are different from those in the first embodiment will be explained.

Inside first cap portion 4731 fixed on capsule member 472 through screw fitting, there is fixed valve member 4740 which has therein glue flowing path 4741, circular cone section 4742 and protrusion 4743.

On the outer circumferential surface of a tip portion of the first cap portion 4731, there is supported second cap portion 4732 to be capable of moving in the axial direction. On the end surface of the second cap portion 4732, there is formed conical opening 4733.

The numeral 4771 represents a rubber seal member inserted between an end surface of a tip portion of capsule member 472 and an inner end surface of the first cap portion 4731, while, the numeral 4772 represents a rubber seal member fixed on an end surface of a tip portion of the first capsule portion 4731.

When moving object 490 is moved by driving means 49 to move connecting means 46 on the supply tube side in the axial direction, inner cylinder member 462 comes in pressure contact with the second cap portion 4732 through rubber seal member 468 to stop and to enter its state of connection.

Under the state of this connection, circular cone section 4742 of the valve member 4740 leaves conical opening 4733 of the second cap portion 4732 to form a space that makes it possible for glue to flow. Further, protrusion 4743 presses check valve 464 of the connecting means 46 on the supply tube side to make it to swing, so that opening 462*b* is opened forcibly. Under the condition of this connection, glue in glue container 47 passes through the glue flowing path 4741 in valve member 4740, then, pass through conical opening 4733 opened by valve member 4740 and through opening 462*b* to be sent to supply tube 451 forcibly.

When glue container 47 is replaced, connection between the connecting means on the glue container side and the connecting means on the supply tube side is released. By driving of driving means 49, connecting means 46 on the supply tube side fixed on moving object 490 is moved, then, engagement between protrusion 4743 and check valve 464 is canceled, and opening 462*b* is closed.

Cam member 495 is fitted rotatably with supporting shaft 494 that is embedded in slide rail 493. Releasing lever 496 is formed integrally on the cam member 495.

When the moving object 490 moves in the direction of an illustrated arrow to the right side in the course of cancellation of connection of the connecting means 46 on the supply tube side, a bottom portion of the moving object 490 presses a cam face on the top surface of cam member 495 to rotate the cam member 495 clockwise as illustrated. A tip portion of releasing lever 496 formed solidly with the cam member 495 presses a left end surface of the second cap portion 4732 to move it to the right side in the illustration. With this movement, conical opening 4733 of the second cap portion 4732 comes in contact with circular cone section 4742 of valve member 4740 to be closed, and it is kept to be in the state shown in FIG. 16. Torsion spring 497 urges the cam member 495 toward the moving object 490 side. Stopper 498 regulates the upper limit position of the cam member 495.

(Fifth Embodiment)

FIGS. 20–22(*c*) show other embodiments of a glue supply means of the invention. FIG. 20 is a sectional top view of a connecting means on the glue container side, FIG. 21(*a*) is a partial side view of the state wherein an opening section of the connecting means on the glue container side is closed, and FIG. 21(*b*) is a partial side view showing the closed the state wherein an opening section of the connecting means on the glue container side is opened. Incidentally, with regard to symbols used in the drawings, parts having the same functions as those in FIGS. 13(*a*)–13(*c*) are given the same symbols. Further, the points which are different from those in the first embodiment will be explained.

On an end surface of the tip portion of capsule member 472, there is formed semicircular ejection opening 472*d*. On the circumference of ejection opening 472*d*, there is glued inner cover 479 which keeps glue Na contained in flexible bag object 471 hermetically. The inner cover 479 is formed by a thin film material in a laminated film shape that is made of an aluminum foil or polyethylene, and it is stuck on an end surface of a tip portion of capsule member 472 through thermal fusion.

The inner cover 479 is protected by cap portion 4734 that engages with capsule member 472 rotatably. Namely, protrusion 4735 of the cap portion 4734 is engaged with a groove portion provided on an outer circumferential surface that is in the vicinity of a tip portion of the capsule member 472, and it is rotatable. At the decentered position that is away from the center of the inner cover 479, there is small diameter hole 4736 that is a through hole. When the small diameter hole 4736 is held at the position shown in FIG. 21(*a*) where the small diameter hole is not overlapped on semicircular ejection opening 472*d*, the inner cover 479 is protected by the cap portion 4734. With regard to unused glue container 47 wherein flexible bag object 471 is filled with glue Na, damage of the inner cover 479 caused by vibrations or shocks generated in the course of storage or transportation can be prevented by the cap portion 4734. Further, for used glue container 47, leakage of glue Na remaining in flexible bag object 471 can be prevented by the cap portion 4734.

When there comes a position shown in FIG. 21(*b*) where small diameter hole 4736 is overlapped with semicircular ejection opening 472*d*, after rotating the inner cover 479, there turns out to be the standby position where the inner cover 479 can be opened.

Each of FIGS. 22(*a*) and 22(*b*) is a sectional top view showing connecting means 46 on the supply tube side and a connecting means on the glue container side which are in the state of non-connection, and FIG. 22(*c*) is a sectional front view showing connecting means 46 on the supply tube side and a connecting means on the glue container side which are in the state of connection.

Prior to connection between connecting means 46 on the supply tube side and a connecting means on the glue container side, when there comes a position shown in FIG. 21(*b*) where small diameter hole 4736 is overlapped with semicircular ejection opening 472*d*, after rotating the cap portion 4734 manually, or by an unillustrated rotating means, there turns out to be the standby position where the inner cover 479 can be opened.

Next, after connecting the connecting means 46 on the supply tube side to the connecting means on the glue container side by driving the driving means 49, pressuring means GS is operated to pressurize glue container 47. Pressurized glue in the glue container 47 passes through ejection opening 472*d* of capsule member 472, then, damages inner cover 479, passes through small diameter hole 4736, then, opens check valve 464, passes through opening 462*b*, and sent to supply tube 451 forcibly to be supplied to glue discharging means 41.

When replacing glue container 47, if motor M2 for releasing pressing is operated to make the connecting means 46 on the supply tube side to leave the connecting means on the glue container side, check valve 464 is urged by the spring and opening 462*b* is closed.

Bookbinding apparatus with a gluing device C of the invention is connected to an image forming apparatus such as a copying machine, a printer and a compound machine thereof. For the sheets ejected out after being subjected to the required digital processing conducted by an image forming apparatus and to the processing such as a single-sided recording, a two-sided recording and pagination editing, cover attaching processing and gluing processing are conducted accurately and efficiently by an image forming apparatus with a bookbinding apparatus with a gluing device C.

Incidentally, it is also possible to form the bookbinding apparatus with a gluing device C of the invention as an independent apparatus, and thereby to conduct gluing and bookbinding for the sheets processed by other image forming apparatuses.

FIGS. 23(*a*)–23(*d*) show the sixth embodiment of a glue supply device of the invention. Each of FIGS. 23(*a*) and 23(*b*) is a sectional view of capsule member 472 of glue container 47 and connecting means 46 to be connected to supply tube 451, FIG. 23(*c*) is a sectional view of capsule member 472 taken on line 23(*c*)–23(*c*), and FIG. 23(*d*) is a sectional view of connecting means 46 taken on line 23(*d*)–23(*d*).

On an end surface of a tip portion of capsule member 472, there is glued and fixed inner cover 473 in the shape of a thin film thin, and it seals hollow ejection opening 472*a* and keeps glue Na contained in flexible bad object 471 to be in the sealed state. Inner cover 473 in the shape of a thin film is formed by a thin film material in a laminated film shape that is made of an aluminum foil or polyethylene, and it is stuck on an end surface of a tip portion of capsule member 472 through thermal fusion.

On the outer surface of inner cover 473 in the shape of a thin film, there is glued and fixed plate-shaped rubber seal member 474. At the central portion of the rubber seal member 474, there is formed opening 474*a*. Rubber seal member 474 is formed by an elastic rubber material such as urethane rubber, ethylene propylene rubber (EPDM), acrylnitryl butadiene rubber (NBR).

In a hollow portion which is positioned to be slightly inside an end surface of a tip portion of capsule member 472, there is solidly formed stopper section 472*c* having a diameter which is smaller than an inside diameter of ejection opening 472*a*. The stopper section 472*c* is connected with an inner wall of capsule member 472 through a plurality of connectors 472*d*, and a plurality of flow holes 472*e* are formed on the stopper section 472*c*.

Connecting means 46 is connected to an end portion on one side of supply tube 451 that makes glue to flow therethrough and to be supplied to glue discharging means 41. The connecting means 46 is composed of first connection member 461 which connects to supply tube 451, second connection member 462 fixed on the opening of the first connection member 461, third connection member 463 connected to the second connection member 462 through screw engagement, movable valve member 464 arranged movably inside the third connection member 463, protrusion-shaped member 465 fixed on a tip portion of the movable valve member 464, outer cover 466 fixed on a tip portion of the third connection member 463, and compression spring 467 that urges the movable valve member 464.

An exit portion of the second connection member 462 is connected with an inner wall of the second connecting member 462 through a plurality of connectors 462*a*, and it forms a plurality of flow holes 462*b*. At the center of the inside of the second connecting member 462, there is formed protrusion 462*c* solidly. A tip portion of the protrusion 462*c* is in pressure contact with compression spring 467.

The compression spring 467 presses the movable valve member 464 to make a circular cone surface formed on an outer circumferential surface of the movable valve member 464 to be brought into pressure contact with an inner wall surface in the vicinity of an opening of the third connecting member 463.

A tip portion of the protrusion-shaped member 465 passes through opening 474*a* provided at the center of rubber seal member 474, then, breaks through inner cover 473 in a shape of a thin film, and comes in contact with stopper section 472*c* of capsule member 472.

An inner circumferential surface of outer cover 466 comes in close contact with an outer circumferential surface of rubber seal member 474 and thereby prevents leakage of glue.

FIG. 24(*a*) is a top view of driving means 49 that moves connecting means 46 in the state of non-connection, and FIG. 24(*b*) is a front view of the driving means 49 in the state of connection.

Gear Z21 fixed on a driving shaft of motor M2 rotates gear Z22 through an unillustrated speed reducing gear train. One end of wire W1 that is trained about pulley PL1 fixed on a rotary shaft of gear Z22 is fixed on one end of moving object 490. Wire W2 fixed on the other end of the moving object 49 is trained about pulleys PL2 and PL3 and is stretched by coil spring 491.

On the moving object 490, there is fixed connecting means 46. Sliding object 492 fixed on the base portion of the moving object 490 advances straight on the surface of slide rail 493 that is fixed on the supply device main body. The slide rail 493 is equipped with a slide bearing and supports the moving object 490 so that it may advance straight.

The moving object 490 is attracted by tensile force of coil spring 491 toward the glue container 47 side to move connecting means 46 connected with supply tube 451 so that the connecting means 46 may be connected with capsule member 472 of the glue container 47.

When glue container 47 is mounted on or dismounted from container mounting section 481 of glue supply means 48 or when the glue container is replaced, motor M2 is driven to rotate pulley PL1 through a power transmission means such as a gear train, and thereby, the moving object 490 is moved straight by rotation of wire W1 against tensile force of coil spring 491 so that connecting means 46 is made to leave the connecting means on the glue container side.

Each of FIGS. 25(*a*)–25(*c*) is a sectional view showing how capsule member 472 of glue container 47 is connected with connecting means 46.

FIG. 25(*a*) shows the state wherein connecting means 46 is made to be close to glue container 47. The connecting means 46 is moved by driving means 49 in the direction of an illustrated void arrow. Outer cover 466 starts fitting with rubber seal member 474, and a tip portion of protrusion member 465 comes in contact with inner cover 473 in a shape of a thin film.

FIG. 25(*b*) shows the state wherein inner cover 473 in a shape of a thin film is broken by a tip portion of protrusion member 465. The connecting means 46 is further moved by the driving means 49 in the direction of an illustrated void arrow. After the outer cover 466 is fitted with rubber seal member 474 to make the inside of the connecting means 46 to be kept in the state of sealing, a tip portion of the protrusion member 465 breaks the inner cover 473 in a shape of a thin film so that glue contained in glue container 47 is made to be capable of being ejected from capsule member 472.

FIG. 25(*c*) shows the state wherein glue ejected from capsule member 472 flows through connecting means 46 to be supplied to supply tube 451. The connecting means 46 is moved by driving means 49 in the direction of an illustrated void arrow. A tip portion of protrusion member 465 breaks inner cover 473 in a shape of a thin film, and then, it hits stopper section 472*c* and stops.

When the connecting means 46 is further moved toward the left side in the drawing, first connecting member 461 connected with supply tube 451, second connecting member 462, third connecting member 463 and outer cover 466 are further moved solidly in the direction of an illustrated void arrow, with protrusion member 465 and movable valve member 464 which are urged by compression spring 467 to be kept in the state of suspension. A clearance between an inner wall on the tip portion of the third connecting member 463 and a circular cone surface of an outer circumference of movable valve member 464 is formed by the movement of the connecting means 46.

Glue in glue container 47 pressurized by pressing actions conducted by pressing members 482A and 482B shown in FIGS. 9(*a*), 9(*b*) and 10 passes through flowing path 472*e* in capsule member 472, broken portion of inner cover 473 in a shape of a thin film and opening 474*a* of rubber seal member 474 to be ejected, and are introduced in connecting means 46 which is in the state of connection.

Glue supplied into the connecting means 46 passes through opening 466*a* of outer cover 466, a clearance section formed by separation of the third connecting member 463 and movable valve member 464, an inner path of the second connecting member 462, flowing path 472*e* of the second connecting member 462 and an inner path of the first connecting member 461, and is supplied to supply tube 451.

(Seventh Embodiment)

Each of FIGS. 26 and 27 is a sectional view showing the seventh embodiment of a glue supply device of the invention. FIG. 26 shows the state wherein connecting means 46 is connected to capsule member 472. FIG. 27 shows the state wherein inner cover 473 in a shape of a thin film that is pasted on an end surface of a tip portion of capsule member 472 has been broken by a movable breaking member. Incidentally, with regard to symbols used in the drawings, parts having the same functions as those in FIGS. 23(*a*)–23(*d*) and FIGS. 14(*a*) and 14(*b*) are given the same symbols. Further, the points which are different from those in the first embodiment will be explained.

On an end surface of a tip portion of capsule member 472, there is pasted inner cover 473 in a shape of a thin film which seals a flow path of unused glue container 47.

Connecting means 46 is composed of first connecting member 461 to be connected to supply tube 451, second connecting member 462 to be connected to the first connecting member 461 and third connecting member 463 to be screw-engaged with the second connecting member 462.

Between an end surface of an inner circumference of the second connecting member 462 and an end surface of an outer circumference of the third connecting member 463, there is inserted rubber seal member 462*d* which prevents leakage of glue. Between an end surface of an inner circumference of the third connecting member 463 and an outer surface of inner cover 473 in a shape of a thin film that is pasted on an end surface of a tip portion of capsule member 472, there is interposed rubber seal member 463*a* which prevents leakage of glue. In the groove section provided on an inside diameter section of the third connecting member 463, there are inserted a plurality of O-rings 463*b*. The O-rings 463*b* are in contact with an outer circumferential surface of capsule member 472 to prevents leakage of glue.

At the center inside the second connecting member 462, there is protruded hollow glue ejection path 462*e*. There is provided hollow guiding section 462*f*, making an acute angle with an entrance section of the glue ejection path 462*e*. Movable breaking member 468 is fitted loosely in an inner wall of the guiding section 462*f* to be capable of moving straight.

A tip portion of the movable breaking member 468 has protrusion-shaped tip portion 468*a* with a sharp edge. Pin 468*b* embedded in a rear end portion of the movable breaking member 468 is engaged with one end of lever 469. The lever 469 is supported on shaft 469*a* rotatably. The other end of the lever 469 is driven to swing by third solenoid SL3.

When the third solenoid SL3 is not operating, the movable breaking member 468 is urged by a spring to slide inside the guiding section 462*f*, and the protrusion-shaped tip portion 468*a* is held to be in the retreated position shown in FIG. 26.

When voltage is impressed on the third solenoid S13, the movable breaking member 468 slides inside the guiding section 462*f* against urging by a spring, and the protrusion-shaped tip portion 468*a* breaks inner cover 473 in a shape of a thin film by breaking through it (see FIG. 27). When an opening of capsule member 472 is opened by breakdown of the inner cover 473 in a shape of a thin film, glue contained in glue container 47 becomes possible to be ejected from capsule member 472.

When impression of voltage on the third solenoid S13 is canceled after the inner cover 473 in a shape of a thin film is broken by the movable breaking member 468, the movable breaking member 468 is restored to its initial position shown in FIG. 26 to make glue ejection path 462*e* to be in the state of full open. Glue ejected from capsule member 472 passes through the glue ejection path 462*e* that is in the state of full open, and is sent to supply tube 451.

(Eighth Embodiment)

Each of FIGS. 28(*a*)–28(*c*) is a sectional view showing the process of glue supply by the eighth embodiment of a glue supply device of the invention. Incidentally, with regard to symbols used in the drawings, parts having the same functions as those in FIGS. 26 and 27 are given the same symbols. Further, the points which are different from those in the second embodiment will be explained.

FIG. 28(*a*) shows the initial position where connecting means 46 is connected to capsule member 472, and inner cover 473 in a shape of a thin film has not yet been broken by movable breaking member 468. A tip portion of the movable breaking member 468 closes an opening of glue ejection path 462*e* to prevent that glue flows out of supply tube 451.

FIG. 28(*b*) shows the state wherein the inner cover 473 in a shape of a thin film has been broken by the movable breaking member 468. A tip portion of the movable breaking member 468 has protrusion-shaped tip portion 468*a* with a sharp edge. When the movable breaking member 468 is advanced by an unillustrated driving means and thereby the protrusion-shaped tip portion 468*a* breaks inner cover 473 in a shape of a thin film by breaking through it, an ejection opening of capsule member 472 is made to be in the state of open, making glue to be capable of being ejected.

FIG. 28(*c*) shows the state of glue supply wherein movable breaking member 468 has retreated to open glue ejection path 462*e*. Immediately after breaking the inner cover 473 in a shape of a thin film, the movable breaking member 468 is retreated by a driving means to open an opening of the glue ejection path 462*e*. Glue contained in glue container 47 is fed forcibly and ejected from an ejection opening of capsule member 472 which is in the state of open, then, pass through an opening of the glue ejection path 462*e* that is in the state of open to be supplied to supply tube 451 through the first connecting member 461.

When the capsule member 472 and the connecting means 46 are made to leave each other for replacement of glue container 47, the movable breaking member 468 is advanced and is held at the position where it closes an opening of the glue ejection path 462*e*. This prevents that glue flows out from the glue ejection path 462*e* side.

For the driving means that moves the movable breaking member 468 to its initial position, the position where inner cover 473 in a shape of a thin film is broken, and the position to open the opening of the glue ejection path 462*e*, a plurality of solenoids or compound operations of an interlocking mechanism and solenoids by driving means 49 are used.

Incidentally, a shape of the tip portion of the movable breaking member 468 is not limited to a double-sided inclination form shown in FIG. 26 and a single-sided inclination form shown in FIG. 18. Further, it is also possible to employ the structure wherein a needle-shaped member having a sharp point is protruded on a tip portion of the movable breaking member 468.

Bookbinding apparatus C with a gluing device equipped with a glue supply device of the invention is connected to an image forming apparatus such as a copying machine, a printer and a compound machine thereof. Sheets ejected after being subjected to requested digital processing by an image forming apparatus and to processing of single-sided recording, two-sided recording or pagination editing are bound immediately by an image forming apparatus equipped with bookbinding apparatus C with a gluing device of the invention, through stable and efficient gluing processing.

It is also possible to make the bookbinding apparatus C with a gluing device of the invention to be an independent apparatus so that it can conduct gluing and bookbinding for sheets processed by other image forming apparatuses.

As is apparent from the explanation stated above, the following effects are produced by a gluing device, a bookbinding apparatus with a gluing device and an image forming apparatus with a bookbinding apparatus.

(1) In the gluing device described in the invention, even when external pressure is applied on a glue container when the glue container is stored or transported, glue contained in the glue container is prevented from leaking out because a valve member (spherical inner cover) presses in the direction to close an ejection opening. Further, leakage of glue from a joint for a glue container in the course of replacement of the glue container and occurrence of glue coating failure caused by entry of air in a joint for a glue container are prevented, which is effective for raising of the efficiency and for an improvement of bookbinding quality.

(2) In the gluing device described in the invention, it is easy to purge air when filling a glue container with glue.

Further, leakage of glue from a joint for a glue container in the course of replacement of the glue container and occurrence of glue coating failure caused by entry of air in a joint for a glue container are prevented.

(3) In the gluing device described in the invention, it is easy to purge air when filling a glue container with glue. Further, when external pressure is applied on a glue container when the glue container is stored or transported, glue contained in the glue container is prevented from leaking out because a valve member (dish-shaped inner cover) presses in the direction to close an ejection opening. Further, leakage of glue from a joint for a glue container in the course of replacement of the glue container and occurrence of glue coating failure caused by entry of air in a joint for a glue container are prevented.

(4) In the bookbinding apparatus with a gluing device of the invention, leakage of glue from a joint for a glue container in the course of replacement of the glue container and occurrence of glue coating failure caused by entry of air in a joint for a glue container are prevented. When external pressure is applied on a glue container when the glue container is stored or transported, it is possible to prevent by an outer cover that an inner cover (thin film material) is broken by glue in a glue container.

(5) In the bookbinding apparatus with a gluing device of the invention, with regard to glue fed out from a glue supply means to a glue discharging device under the prescribed pressure, glue in a certain amount is discharged from a glue discharging means, and is coated evenly on an edge portion of a sheet. The sheet subjected to glue coating processing is housed in a sheet housing means of a collating and pressuring means wherein close contact with the glue coated portion is conducted, which improves quality of finish for bookbinding.

(6) In an image forming apparatus equipped with the bookbinding apparatus with a gluing device of the invention, it is possible to conduct bookbinding processing automatically in succession by conducting gluing processing with the bookbinding apparatus with a gluing device, for the sheets ejected at high speed from the image forming apparatus.

Further, the following effects are produced by a glue supply method and a glue supply device of the invention.

(7) In the glue supply method and the glue supply device described in the invention, leakage of glue to the outside from a capsule member or a connecting means can be prevented, when the capsule member for ejection of glue in a glue container is connected with a supply tube to be connected to a glue discharging means through a connecting means. Further, when removing the connecting means from the capsule member, glue remaining in the supply tube does not leak out because a movable valve member of the connecting means is brought into contact with an inner wall of the third connecting member by urging of a compression spring.

Further, when replacing a glue container, it is possible for an operator to conduct replacement operations simply without soiling hands by breaking the inner cover in a shape of a thin film that seals a glue ejection opening of the capsule member with a protrusion-shaped member to supply to the supply tube side, after fixing a glue container on a container mounting section.

(8) In the glue supply method and the glue supply device described in the invention, leakage of glue to the outside from a capsule member or a connecting means can be prevented, when the capsule member for ejection of glue in a glue container is connected with a supply tube to be connected to a glue discharging means through a connecting means. Further, when replacing a glue container, it is possible for an operator to conduct replacement operations simply without soiling hands by breaking the inner cover in a shape of a thin film that seals a glue ejection opening of the capsule member with a movable breaking member to supply to the glue supply tube side, after fixing a glue container on a container mounting section.

(9) When a glue container is mounted or dismounted with a glue supply device described in the invention, the movable breaking member that breaks an inner cover in a shape of a thin film is on standby at the position to intercept a glue ejection path and conducts operations of a movable switching valve. Further, when removing the connecting means from the capsule member, glue remaining on the supply tube side is prevented from leaking to the outside of from the connecting means.

What is claimed is:

1. A gluing device comprising:

(a) a glue container containing a liquid glue;

(b) a pressuring means for pressing the glue container to eject the glue from an ejection opening;

(c) a supply tube through which the glue is transported from the ejection opening;

(d) a first connecting means provided on a glue container side for connecting the supply tube to the glue container;

(e) a second connecting means provided on a supply tube side for detachably connecting the first connecting means to the supply tube; and (f) a glue discharging means for receiving the glue transported through the supply tube and for delivering the glue from a nozzle opening, wherein the first connecting means comprises therein a valve member for opening and closing the ejection opening, and the second connecting means comprises therein a protrusion so that the protrusion presses the valve member to open the ejection opening when the second connecting means is connected to the first connecting means.

2. The gluing device of claim 1, wherein the second connecting means comprises therein a check valve and an urging means, when the second connecting means is connected to the first connecting means, the glue contained in the glue container is ejected by the pressuring means from the ejection opening to make the check valve to be open, and when the second connecting means is not connected to the first connecting means, the check valve is made to be closed by the urging means.

3. The gluing device of claim 1, wherein the first connecting means comprises a resilient member for closing the ejection opening by urging the valve member.

4. The gluing device of claim 3, wherein the valve member is a spherical valve having a diameter larger than an inner diameter of the ejection opening.

5. The gluing device of claim 3, wherein the valve member is a dish-shaped valve having an area greater than an area of the ejection opening.

6. The gluing device of claim 1, wherein the first connecting means has an inclined surface portion on an inner wall thereof, and the valve member closes the ejection opening by moving along the inclined surface portion by gravity thereof.

7. The gluing device of claim 1, wherein the second connecting means is mounted to a moving body connected to a driving source, which is capable of moving forward and backward, and the first connecting means and the second connecting means are connected to or separated from each other, by driving the moving body.

8. A gluing device comprising:

(a) a glue container containing a liquid glue;

(b) a pressuring means for pressing the glue container to eject the glue from an ejection opening;

(c) a supply tube through which the glue is transported from the ejection opening;

(d) a first connecting means provided on a glue container side which is connected to the glue container;

(e) a second connecting means provided on the supply tube side which is detachably connected to the first connecting means and is connected to a receiving portion of the supply tube; and (f) a glue discharging means for receiving the glue transported through the supply tube and for discharging the glue from a nozzle opening, wherein the first connecting means comprises a first connection member that is connected to the ejection opening of the glue container, a valve member that is arranged inside the first connection member and has, on its tip portion, a cone portion, a second connection member that closes a glue flowing path with a cone surface which engages with the cone portion of the valve member and has a moving means that moves the second connection member, and wherein the moving means moves the second connection member of the first connecting means to separate the cone portion of the valve member from the cone surface of the second connection member and thereby to enable the glue in the glue container to be supplied to the glue discharging means, interlocking with operations for connecting the second connecting means to the first connecting means.

9. The gluing device of claim 8, wherein the second connecting means comprises therein a check valve and an urging means and the valve member has a projection portion, when the second connecting means is not connected to the first connecting means, the check valve is held to be closed by the urging means, and when the second connecting means is connected to the first connecting means, the projection portion comes into contact with the check valve whereby the glue flowing path is opened, the glue contained in the glue container is supplied to the glue discharging means.

10. The gluing device of claim 8, wherein the second connecting means is mounted to a moving body connected to a driving source, which is capable of moving forward and backward, and the moving means moves the second connection member by driving the moving body and whereby enables the glue in the glue container to be supplied to the glue discharging means.

11. A gluing device:

(a) a glue container containing a liquid glue;

(b) a pressuring means for pressing the glue container to eject the glue from an ejection opening;

(c) a supply tube through which the glue is transported from the glue container;

(d) a first connecting means provided on the glue container side which is connected to the glue container;

(e) a second connecting means provided on the supply tube side which is detachably connected to the first connecting means and is connected to a receiving portion of the supply tube; and (f) a glue discharging means for receiving the glue transported through the supply tube and for discharging the glue from a nozzle opening, wherein the first connecting means is formed in a double-structure shape including a membrane member that closes the ejection opening of the glue container and is capable of being opened and closed and an outer cover member that protects the membrane member and has an opening which agrees positionally with the ejection opening when it is rotated, and wherein after the ejection opening of the glue container and the opening of the outer cover member are made to agree with each other, the second connecting means is connected to the first connecting means, and the pressuring means presses so that the membrane member is ruptured by pressure of the glue in the glue container, thus the glue in the glue container is supplied to the glue discharging means.

12. The gluing device of claim 11, wherein the second connecting means comprises therein a check valve and an urging means, when the second connecting means is not connected to the first connecting means, the check valve is held to be closed by the urging means, and when the second connecting means is connected to the first connecting means, the glue flowing path is opened by pressure of the glue in the glue container caused by the pressuring means, thus the glue in the glue container is supplied to the glue discharging means.

13. The gluing device of claim 11, wherein the second connecting means is mounted to a moving body connected to a driving source, which is capable of moving forward and backward, and the first connecting means and the second connecting means are connected to or separated from each other, by driving the moving body.

* * * * *